US009853395B2

(12) United States Patent
Tanaka et al.

(10) Patent No.: US 9,853,395 B2
(45) Date of Patent: Dec. 26, 2017

(54) CONNECTOR AND CONNECTOR ASSEMBLY

(71) Applicant: JAPAN AVIATION ELECTRONICS INDUSTRY, LIMITED, Shibuya-ku, Tokyo (JP)

(72) Inventors: Yukitaka Tanaka, Tokyo (JP); Akira Kimura, Tokyo (JP); Yoshihide Kuroki, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/202,354

(22) Filed: Jul. 5, 2016

(65) Prior Publication Data

US 2017/0093088 A1 Mar. 30, 2017

(30) Foreign Application Priority Data

Sep. 29, 2015 (JP) ..... 2015-190801

(51) Int. Cl.

| | |
|---|---|
| ***H01R 13/627*** | (2006.01) |
| ***H01R 13/621*** | (2006.01) |
| *H01R 13/502* | (2006.01) |
| *H01R 24/62* | (2011.01) |
| *H01R 107/00* | (2006.01) |

(52) U.S. Cl.

CPC ..... *H01R 13/6215* (2013.01); *H01R 13/502* (2013.01); *H01R 24/62* (2013.01); *H01R 2107/00* (2013.01)

(58) Field of Classification Search

CPC ..... H01R 13/6215; H01R 13/514

USPC ..... 439/362, 372

See application file for complete search history.

(56) References Cited

U.S. PATENT DOCUMENTS 4,460,230 A * 7/1984 McKee ..... H01R 13/516 439/359
4,577,919 A * 3/1986 Waters ..... H01R 13/65802 439/362
4,589,716 A * 5/1986 Williams, II ..... H01R 13/6275 439/256
4,709,975 A * 12/1987 Williams, II ..... H01R 13/6275 439/350
4,934,950 A * 6/1990 Green ..... H01R 13/6453 439/362
5,154,629 A * 10/1992 Carver ..... G02B 6/3817 439/352

(Continued)

FOREIGN PATENT DOCUMENTS

JP 3113056 U 9/2005
JP 2008251248 A 10/2008

*Primary Examiner* — Tulsidas C Patel
*Assistant Examiner* — Peter G Leigh
(74) *Attorney, Agent, or Firm* — Holtz, Holtz & Volek PC

(57) ABSTRACT

A connector includes a connector main, a male screw member and a screw holding member. The connector main selectively connectable with a mating connector having a female screw portion and another mating connector having no female screw portion in a predetermined direction. The screw holding member holds the male screw member. The screw holding member has a male screw seat which is brought into contact with a female screw seat when the male screw member is connected with the female screw portion. The screw holding member is attached to the connector main and relatively moveable with respect to the connector main in the predetermined direction.

25 Claims, 32 Drawing Sheets

(56) References Cited

U.S. PATENT DOCUMENTS 5,197,900 A * 3/1993 Ellis ..... H01R 13/6275 439/350
5,316,495 A * 5/1994 Frantz ..... H01R 13/6215 292/115
5,342,216 A * 8/1994 Davis ..... H01R 13/6581 439/362
5,733,137 A * 3/1998 Knoop ..... H05K 7/1407 29/432.2
5,775,931 A * 7/1998 Jones ..... H01R 13/631 439/358
5,921,801 A * 7/1999 O'Sullivan ..... H01R 13/748 439/362
6,095,845 A * 8/2000 Murphy ..... H01R 13/6215 439/364
6,241,548 B1 * 6/2001 Kuo ..... H01R 13/6215 439/358
6,777,619 B1 * 8/2004 Badinski ..... H01R 13/6215 174/135
6,866,533 B2 * 3/2005 Wu ..... H01R 13/6335 439/352
6,869,301 B2 * 3/2005 Shimizu ..... H01R 13/6276 439/324
7,037,131 B1 * 5/2006 Chen ..... H01R 13/6275 439/362
7,074,065 B1 * 7/2006 Martinez ..... H01R 13/6315 439/247
7,083,462 B1 * 8/2006 Chen ..... H01R 13/62966 439/362
7,086,889 B2 * 8/2006 Yin ..... H01R 13/6395 439/358
7,128,582 B2 * 10/2006 Fang ..... H01R 13/514 439/362
7,163,412 B2 * 1/2007 Fan ..... H01R 13/6205 439/258
7,210,954 B2 * 5/2007 Ohki ..... H01R 13/6215 439/362
7,272,009 B2 * 9/2007 Sura ..... G06F 1/183 165/80.3
7,479,026 B2 * 1/2009 Furusawa ..... H01R 13/502 439/362
7,544,084 B1 * 6/2009 Dutton ..... G02B 6/387 439/465
7,744,399 B1 * 6/2010 Gibbs ..... H01R 13/6275 439/362
7,749,015 B2 * 7/2010 Uchikawa ..... H01R 13/6395 439/362
7,988,485 B2 * 8/2011 Zhang ..... H01R 13/639 439/372
8,062,054 B2 * 11/2011 Su ..... H01R 13/502 439/362
8,888,517 B2 * 11/2014 Becavin ..... H01R 13/74 439/153
9,337,577 B1 * 5/2016 Hitchcock ..... H01R 13/6315
9,461,425 B2 * 10/2016 Tamaki ..... H01R 13/508
2008/0242149 A1 10/2008 Konno et al.

* cited by examiner

CONNECTOR AND CONNECTOR ASSEMBLY

CROSS REFERENCE TO RELATED APPLICATIONS

This application is based on and claims priority under 35 U.S.C. §119 to Japanese Patent Application No. JP2015-190801 filed Sep. 29, 2015, the contents of which are incorporated herein in their entirety by reference.

BACKGROUND OF THE INVENTION

This invention relates to a connector having a male screw member. In addition, this invention relates to a connector assembly comprising the aforementioned connector and a mating connector having a female screw.

As shown in FIG. 56, JPA 2008-251248 (Patent Document 1) discloses a connector assembly which includes a plug 900 and a receptacle 930. The plug 900 and the receptacle 930 are designed so that a contact 920 of the plug 900 and a mating contact 960 of the receptacle 930 are properly brought into contact with each other when an end 910 of the plug 900 is brought into abutment with an inner wall 950 of a receiving portion 940 of the receptacle 930.

As shown in FIG. 57, JPU 3113056 (Patent Document 2) discloses a receptacle 970 which has female screw portions 980. A plug (not show) mateable with the receptacle 970 is provided with male screw members, which are connectable with the female screw portions 980, and screw holding members, which hold the male screw members, respectively.

Currently, a receptacle (hereinafter referred to as "receptacle A") having a female screw portion has been supposed as a mating connector for a plug (hereinafter referred to as "plug A") having a male screw member. Furthermore, another receptacle (hereinafter referred to as "receptacle B") having no female screw portion is supposed as another mating connector for another plug (hereinafter referred to as "plug B") having no male screw member. For example, the receptacle A is a receptacle like the receptacle 970 of Patent Document 2 while the plug A is a plug (not shown) which is mateable with the receptacle A. Furthermore, the plug B is a plug like the plug 900 of Patent Document 1 while the receptacle B is a receptacle like the receptacle 930 of Patent Document 1, for example.

Even when the plug A and the plug B have interfaces (fitting portions) same as each other, there is a case where the plug A cannot be properly connected with the receptacle B. The receptacle B like the receptacle 930 of Patent Document 1 is generally arranged in a housing of an electric device. When the plug A is tried to be connected with that kind of the receptacle B, a male screw member or a screw holding member is brought into abutment with the housing so that an end of the plug A cannot be brought into abutment with an inner wall of a receiving portion of the receptacle B. Therefore, the plug A cannot be properly connected with the receptacle B.

SUMMARY OF THE INVENTION

It is an object of the present invention to provide a connector which has a male screw member and which is properly mateable with not only a mating connector having a female screw connector but also another mating connector having no female screw connector.

One aspect (first aspect) of the present invention provides a connector having a front end in a predetermined direction and selectively connectable with a first connecting object and a second connecting object along the predetermined direction. The first connecting object comprises a first fitting portion having a mating contact, a female screw portion and a female screw seat. The second connecting object comprises a second fitting portion having a structure corresponding to the first fitting portion. The connector comprises a connector main, a male screw member and a screw holding member. The connector main is selectively mateable with the first fitting portion and the second fitting portion in the predetermined direction. The connector main has a contact which is brought into contact with the mating contact when the connector and the first connecting object are connected with each other. The screw holding member holds the male screw member. The screw holding member has a male screw seat which is brought into contact with the female screw seat when the male screw member is connected with the female screw portion. The screw holding member is attached to the connector main. The screw holding member is relatively movable with respect to the connector main in the predetermined direction.

Another aspect (second aspect) of the present invention provides a connector assembly comprising the connector of the first aspect and a mating connector as the first connecting object. The mating connector comprises the first fitting portion, the female screw portion and the female screw seat.

A connector of the present invention is mateable with a first connecting object like a mating connector which has a female screw portion corresponding to a male screw member. The connector of the present invention has a screw holding member which is relatively movable with respect to a connector main in a predetermined direction. Accordingly, when the connector is tried to be mated with a second connecting object like an electric device in which another mating connector having no female screw portion is arranged in a housing of the electric device, there is no case where the screw holding member is brought into abutment with the housing to keep on adding stress on the housing. Therefore, the connector main can be properly mated with a second fitting portion of the second connecting object.

An appreciation of the objectives of the present invention and a more complete understanding of its structure may be had by studying the following description of the preferred embodiment and by referring to the accompanying drawings.

Figure 1:
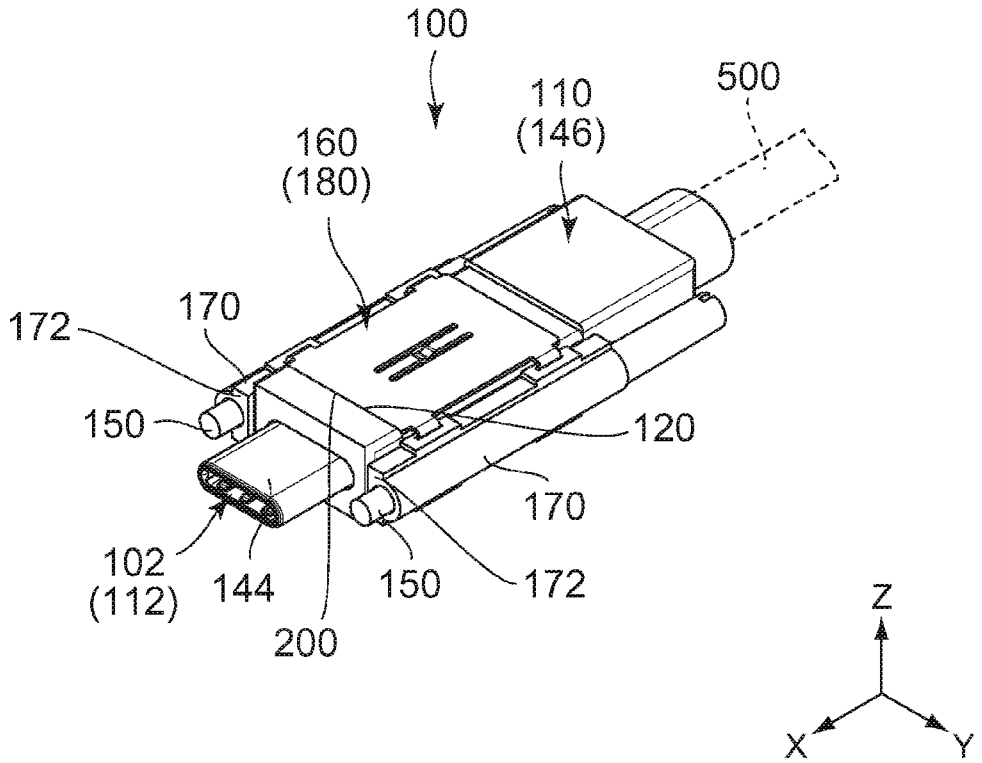
FIG. 1 is a top, perspective view showing a connector according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 4:
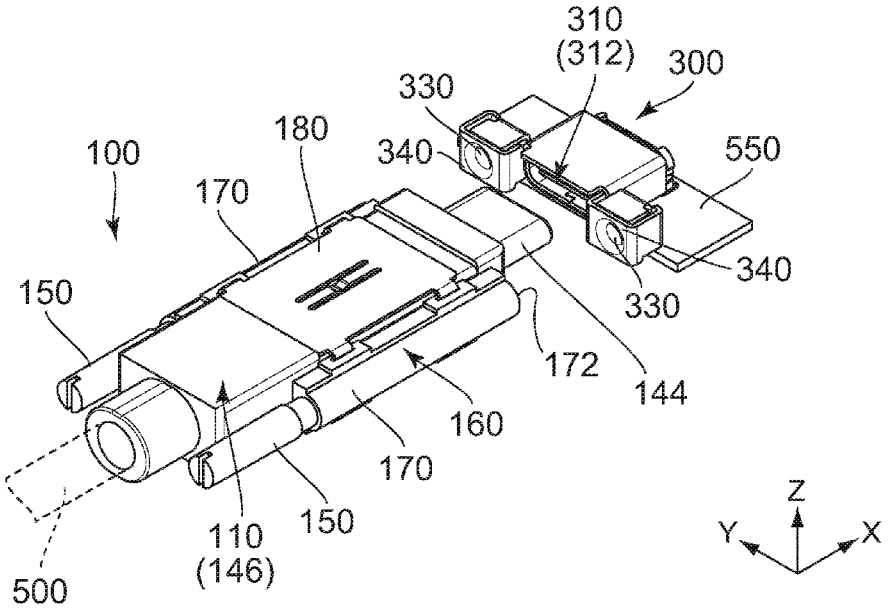
FIG. 4 is a top, perspective view showing the connector of FIG. 1 and a first connecting object. The illustrated connector is not connected with the illustrated first connecting object.
Figure 5:
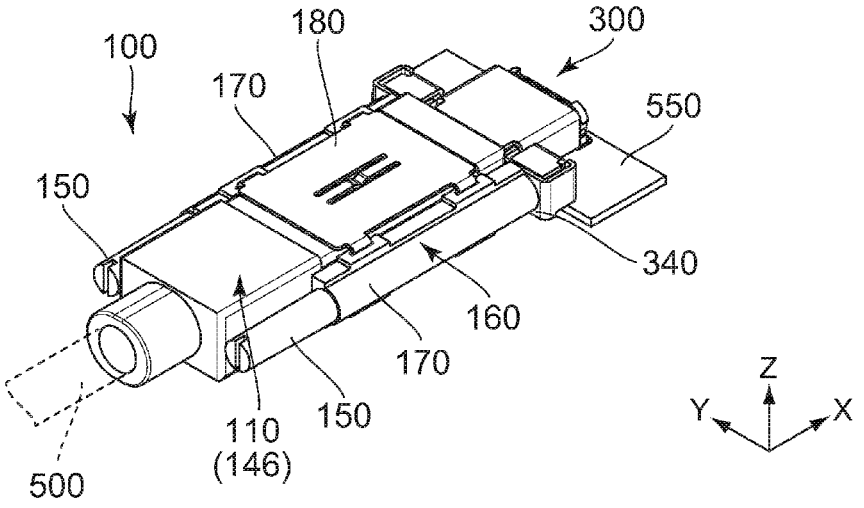
FIG. 5 is another top, perspective view showing the connector and the first connecting object of FIG. 4. The illustrated connector is connected with the illustrated first connecting object.
Figure 6:
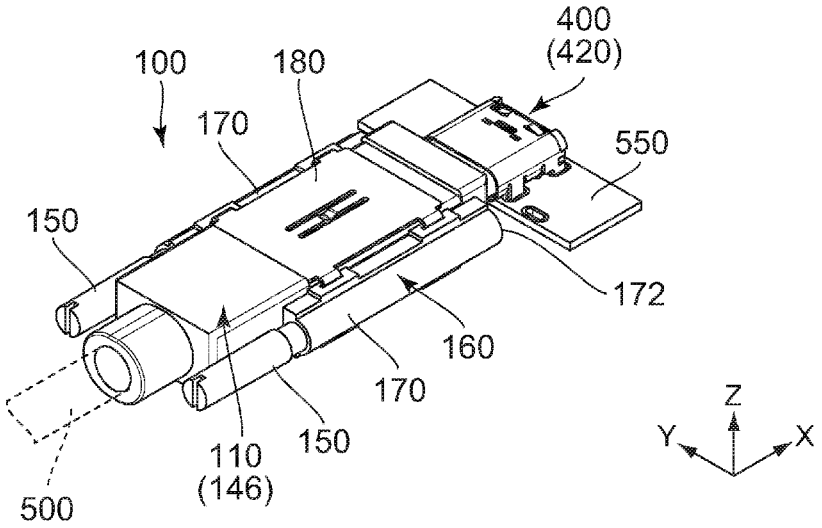
FIG. 6 is a top, perspective view showing the connector of FIG. 1 and a mating connector of a second connecting object. The illustrated connector is connected with the illustrated mating connector.

Referring to FIG. 1, a connector 100 according to a first embodiment of the present invention is a plug which is in accordance with Universal Serial Bus (USB) Type-C Standard. Referring to FIGS. 4 to 6 in addition to FIG. 1, the connector 100 of the present embodiment has a front end 102 in a predetermined direction and is selectively mateable with a first connecting object 300 and a second connecting object 400 along the predetermined direction. In the present embodiment, the predetermined direction is an X-direction. Specifically, in the present embodiment, a positive X-direction is a forward direction while a negative X-direction is a rearward direction.

Figure 8:
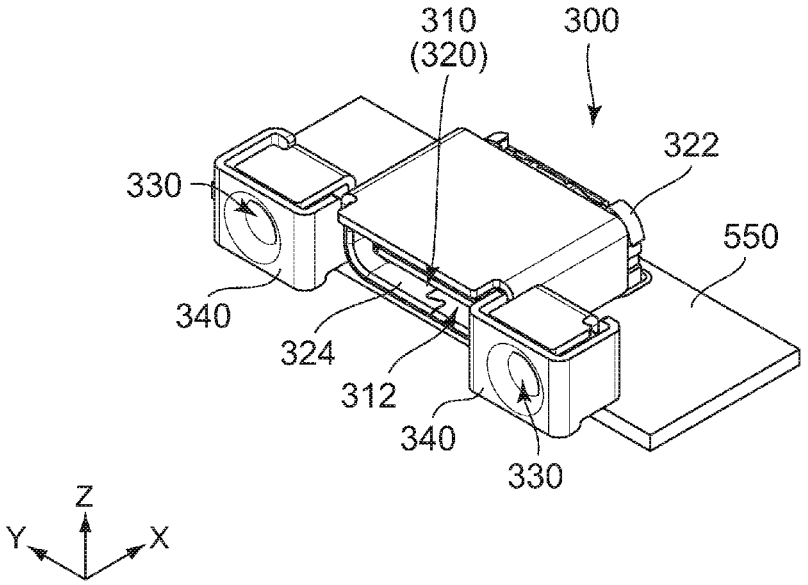
FIG. 8 is a top, perspective view showing the first connecting object of FIG. 5.
Figure 9:
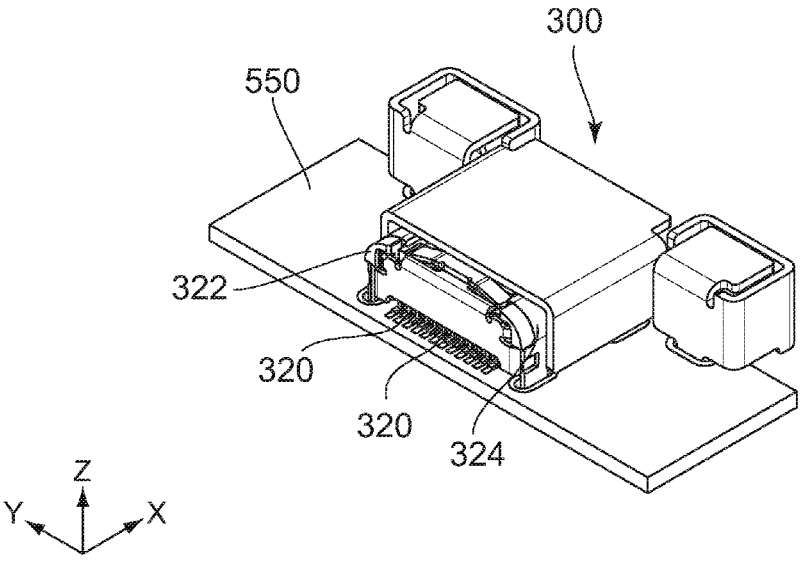
FIG. 9 is another top, perspective view showing the first connecting object of FIG. 5.
Figure 10:
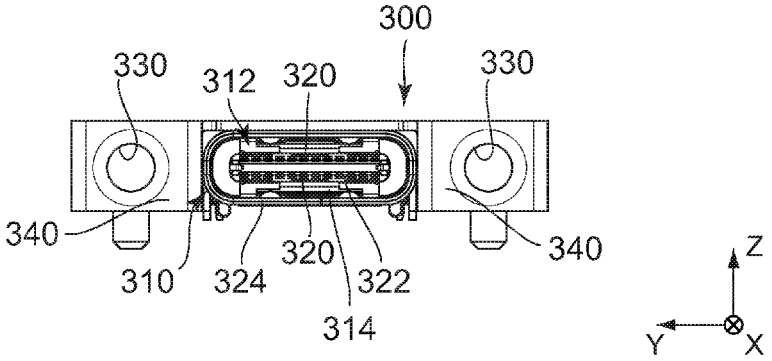
FIG. 10 is a front view showing the first connecting object of FIG. 5. A circuit board of the illustrated first connecting object is omitted in the figure.

As shown in FIGS. 4, 5, and 8 to 10, in the present embodiment, the first connecting object 300 is a mating connector connectable with the connector 100 and, more specifically, is a receptacle being in accordance with USB Type-C Standard. As shown in FIG. 8, the first connecting object 300 is mounted on and fixed to a circuit board 550 and provided with a first fitting portion 310, two female screw portions 330 and two female screw seats 340. In other words, the first connecting object 300 of the present embodiment is the receptacle having the female screw portions 330 while the first fitting portion 310 has a receiving portion 312. As shown in FIG. 10, the receiving portion 312 has an inner wall 314 in the predetermined direction. The first fitting portion 310 is located between the female screw portions 330 in a lateral direction perpendicular to the predetermined direction. In the present embodiment, the lateral direction is a Y-direction. As shown in FIG. 10, in detail, the first fitting portion 310 is provided with mating contacts 320, a mating holding member 322 and a mating shell 324. The mating holding member 322 holds the mating contacts 320. The mating shell 324 surrounds the mating holding member 322.

Figure 7:
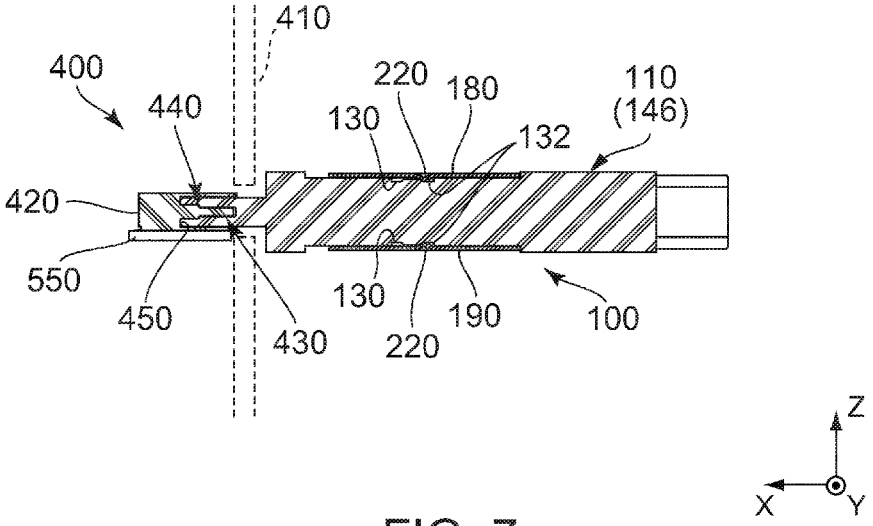
FIG. 7 is a cross-sectional view showing the connector and the second connecting object of FIG. 6. In order to easily recognize outlines of the connector and the second connecting object, detailed illustration is omitted in the figure.
Figure 11:
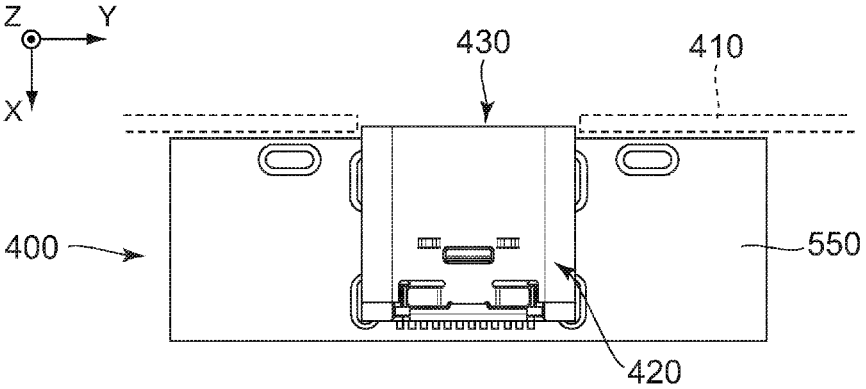
FIG. 11 is a top view showing the second connecting object of FIG. 6.
Figure 12:
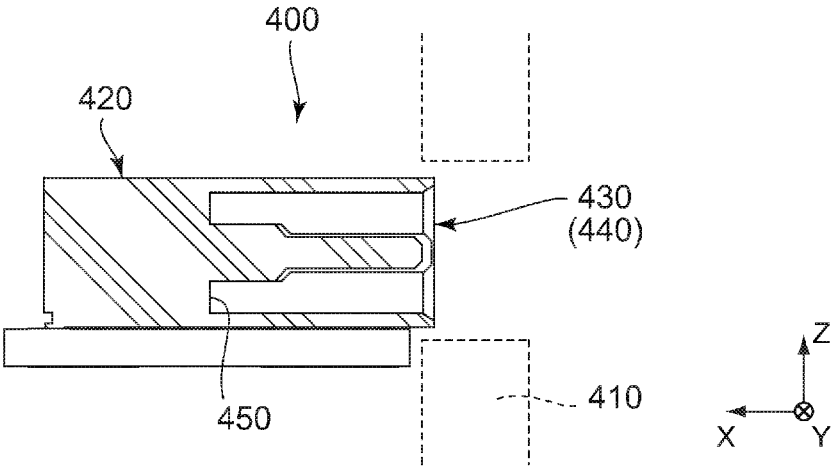
FIG. 12 is a cross-sectional view showing the second connecting object of FIG. 11. In order to easily recognize an outline of the second connecting object, detailed illustration is omitted in the figure.
Figure 13:
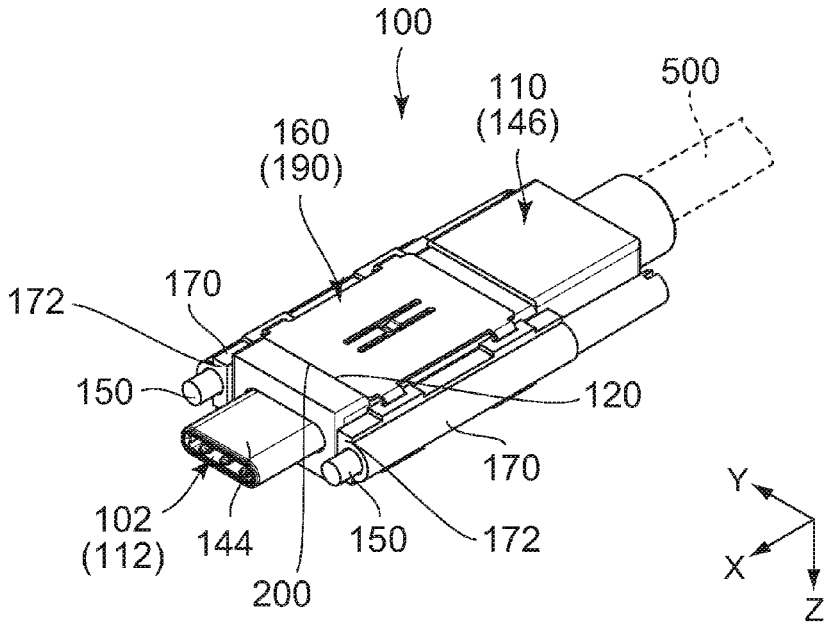
FIG. 13 is a bottom, perspective view showing the connector of FIG. 1.

As understood from FIGS. 8 and 11, though the second connecting object 400 is provided with a second fitting portion 430 having a structure corresponding to the first fitting portion 310, it does not have female screw portions like the female screw portions 330. As shown in FIGS. 7, 11 and 12, the second connecting object 400 of the present embodiment is a housing 410 of an electric device (not shown) with a mating connector 420 arranged therein. As understood from FIGS. 8 and 11, the mating connector 420 has a structure corresponding to the first connecting object 300. Specifically, the mating connector 420 is a receptacle which is in accordance with USB Type-C Standard and which does not have the female screw portions like the female screw portions 330. As shown in FIG. 12, the mating connector 420 has the aforementioned second fitting portion 430. The second fitting portion 430 has a receiving portion 440 having an inner wall 450 in the predetermined direction.

Figure 2:
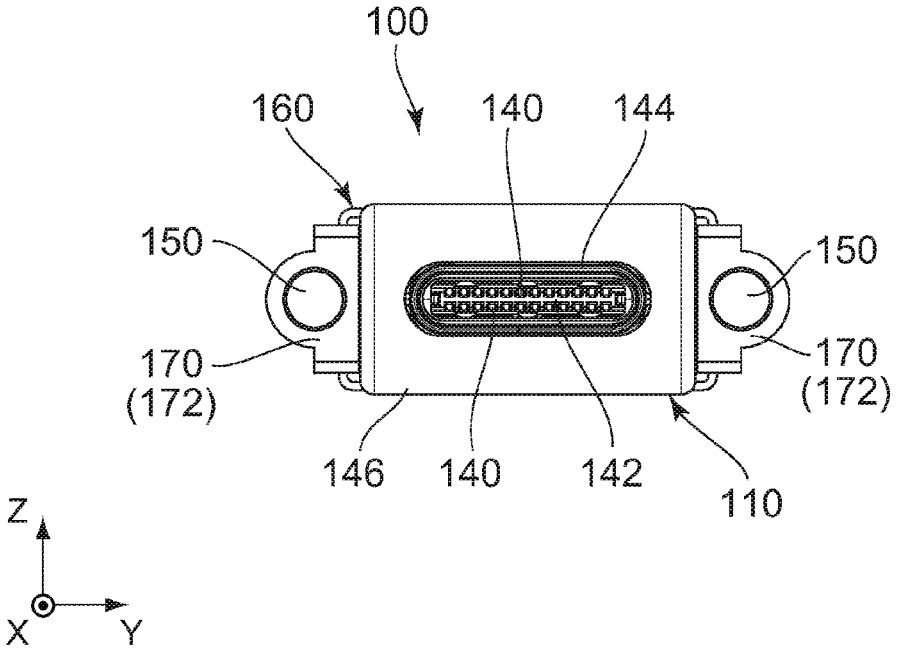
FIG. 2 is a front view showing the connector of FIG. 1.
Figure 3:
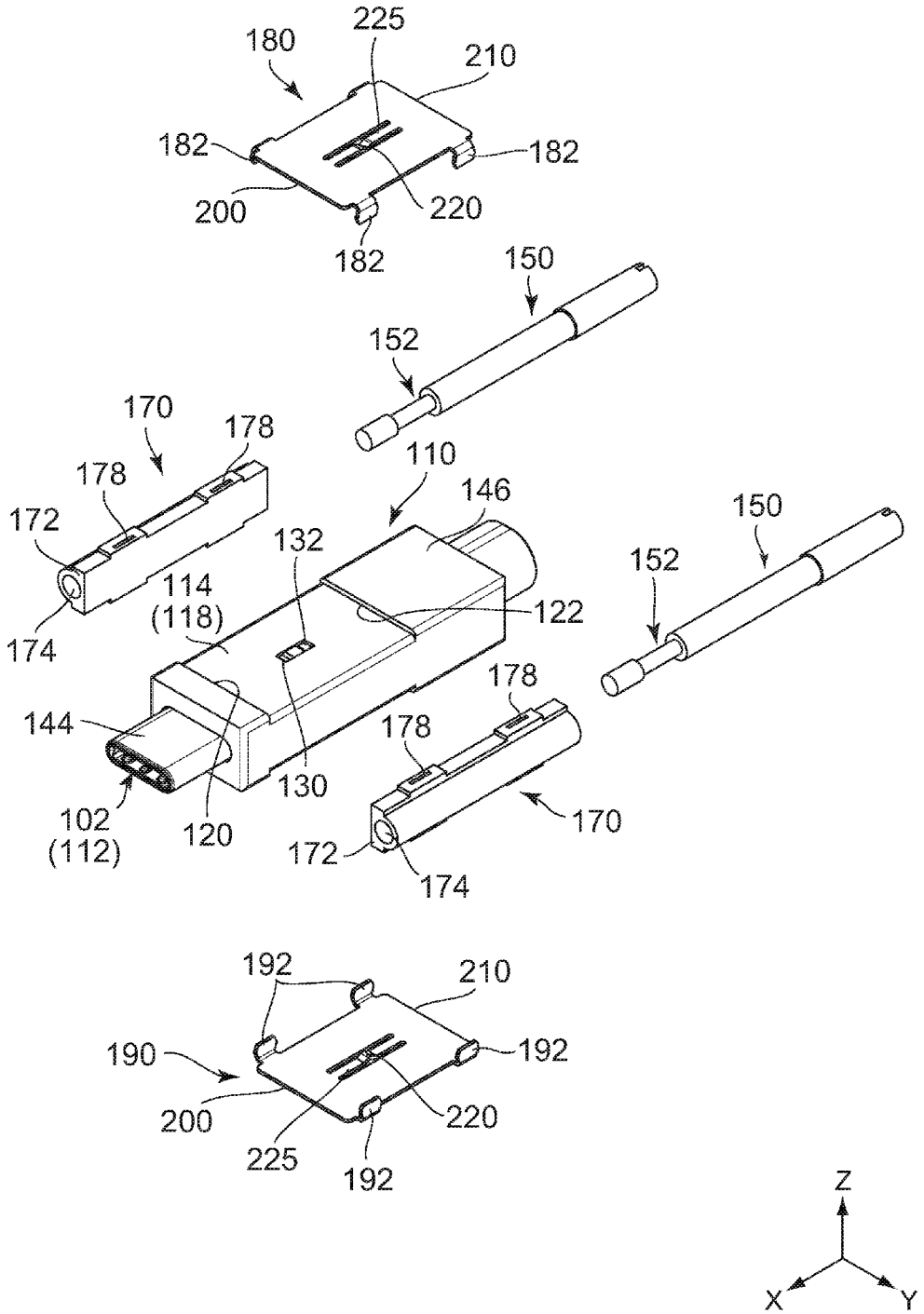
FIG. 3 is an exploded, perspective view showing the connector of FIG. 1.

As shown in FIGS. 1 to 3, the connector 100 includes a connector main 110, two male screw members 150 and a screw holding member 160.

As shown in FIG. 2, the connector main 110 of the present embodiment is positioned between the two male screw members 150 in the lateral direction. The connector main 110 includes contacts 140, a holding member 142, a shell 144 and a hood 146. As understood from FIGS. 2 and 10, when the connector 100 and the first connecting object 300 are connected with each other, the contacts 140 are brought into contact with the mating contacts 320, respectively. As shown in FIG. 2, the holding member 142 holds the contacts 140. The shell 144 surrounds the holding member 142. As understood from FIG. 1, a rear end of the shell 144 is positioned inside the hood 146. A relay board (not shown), which connects a cable 500 with the contacts 140, or the like is accommodated in the hood 146. The cable 500 which is connected to the relay board (not shown) extends rearward from the hood 146 in the predetermined direction.

As shown in FIG. 1, an end 112 of the connector main 110 forms a front end 102 of the connector 100. As understood from FIGS. 4 and 7, the connector main 110 is selectively mateable with any of the first fitting portion 310 and the second fitting portion 430 along the predetermined direction. As understood from FIGS. 4 and 5, when the connector 100 is connected with the first connecting object 300, the connector main 110 is partially received in the receiving portion 312 of the first fitting portion 310.

Figure 17:
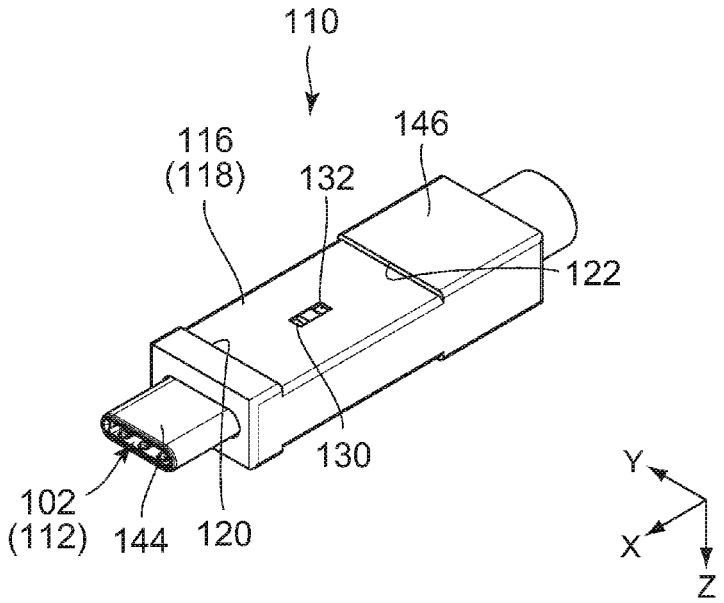
FIG. 17 is a bottom, perspective view showing a connector main which is included in the connector of FIG. 1.

As shown in FIGS. 3 and 17, each of an upper surface 114 and a lower surface 116 of the connector main 110 is provided with a slide surface 118, a front facing portion 120 and a rear facing portion 122. However, the present invention is not limited thereto. The slide surface 118, the front facing portion 120 and the rear facing portion 122 may be provided on one of the upper surface 114 and the lower surface 116 of the connector main 110. The slide surface 118 is positioned between the front facing portion 120 and the rear facing portion 122 in the predetermined direction. The front facing portion 120 is a wall which is positioned forward of the slide surface 118 and which stands in an up-down direction perpendicular to both of the predetermined direction and the lateral direction. In this embodiment, the up-down direction is Z-direction. Specifically, a positive Z-direction is upward while a negative Z-direction is downward. The rear facing portion 122 is a wall which is positioned rearward of the slide surface 118 and which stands in the up-down direction. In the present embodiment, each of the slide surfaces 118, the front facing portions 120 and the rear facing portions 122 is formed on the hood 146. In addition, each of the front facing portions 120 functions as a regulated portion as described later.

Furthermore, each of the upper surface 114 and the lower surface 116 of the connector main 110 is provided with a front recess 130 and a rear recess 132 which are positioned away from each other in the predetermined direction. However, the present invention is not limited thereto. The front recess 130 and the rear recess 132 may be provided on one of the upper surface 114 and the lower surface 116 of the connector main 110. In the present embodiment, the front recess 130 and the rear recess 132 are formed on the slide surface 118 of the hood 146.

As understood from FIGS. 1 and 3, the screw holding member 160 is attached to the connector main 110. As shown in FIGS. 1 and 13 to 16, the screw holding member 160 is relatively movable between a front predetermined position and a rear predetermined position with respect to the connector main 110 along the predetermined direction.

In detail, as shown in FIG. 3, the screw holding member 160 includes two screw accommodation members 170, an upper movable member 180 and a lower movable member 190. As understood from FIGS. 1 and 3, each of the upper movable member 180 and the lower movable member 190 couples the two screw accommodation members 170 with each other in the lateral direction. Each of the upper movable member 180 and the lower movable member 190 of the present embodiment principally has a plate-like shape and is provided with press-fit pieces 182, 192 at opposite ends thereof in the lateral direction. Each of the screw accommodation members 170 is provided with press-fit ditches 178. The press-fit pieces 182, 192 are press-fit into the press-fit ditches 178 so that the two screw accommodation members 170 are coupled by the upper movable member 180 and the lower movable member 190. As understood from FIGS. 1 and 13, the upper movable member 180 and the lower movable member 190 sandwich the connector main 110 in the up-down direction. The upper movable member 180 is movable on the upper surface 114 of the connector main 110 in the predetermined direction. The lower movable member 190 is movable on the lower surface 116 of the connector main 110 in the predetermined direction. As understood from FIGS. 1, 3, 13 and 17, specifically, the upper movable member 180 is slidable in the predetermined direction on the slide surface 118 which is positioned on an upper side of the connector main 110 in the up-down direction, and the lower movable member 190 is slidable in the predetermined direction on the slide surface 118 which is positioned on an lower side of the connector main 110 in the up-down direction.

As shown in FIG. 3, each of the upper movable member 180 and the lower movable member 190 has a front abutment portion 200 and a rear abutment portion 210. However, the present invention is not limited thereto. The front abutment portion 200 and the rear abutment portion 210 may be provided on one of the upper movable member 180 and the lower movable member 190. As understood from FIGS. 1 and 13 to 16, in the present embodiment, the front abutment portion 200 faces the front facing portion 120 in the predetermined direction and is positioned rearward of the front facing portion 120. The rear abutment portion 210 faces the rear facing portion 122 in the predetermined direction and is positioned forward of the rear facing portion 122. Accordingly, in the predetermined direction, the front facing portion 120 regulates a forward movement of the front abutment portion 200 beyond the front facing portion 120. Similarly, in the predetermined direction, the rear facing portion 122 regulates a rearward movement of the rear abutment portion 210 beyond the rear facing portion 122.

As understood from above, the front abutment portion 200 of the present embodiment functions as a regulating portion for the front facing portion (regulated portion) 120. In detail, the front abutment portion 200 is arranged rearward of the front facing portion (regulated portion) 120 in the predetermined direction while facing the front facing portion (regulated portion) 120, and the front abutment portion 200 regulates a rearward movement of the front facing portion (regulated portion) 120 beyond the regulating portion in the predetermined direction. In other words, the screw holding member 160 of the present embodiment is provided with the regulating portion which is arranged rearward of the regulated portion in the predetermined direction while facing the regulated portion in the predetermined direction. The regulating portion regulates a rearward movement of the regulated portion beyond the regulating portion in the predetermined direction.

Figure 18:
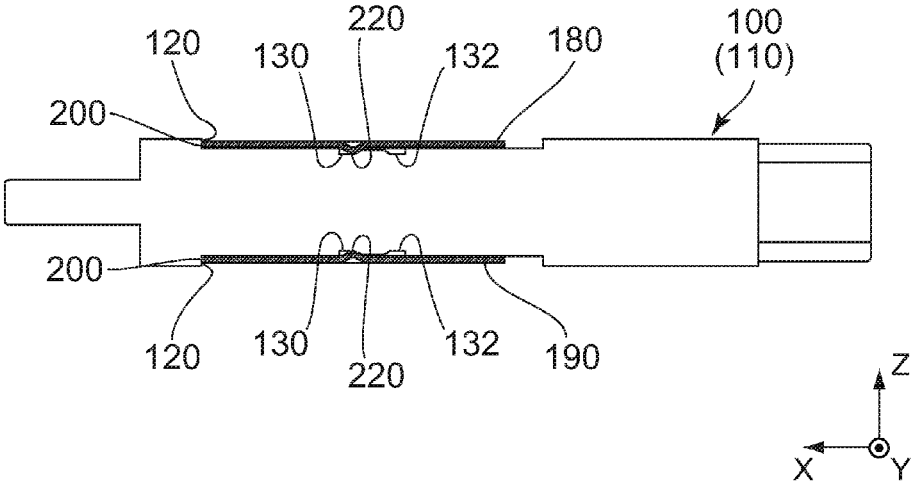
FIG. 18 is a view showing a positional relationship among each of front recesses, each of rear recesses and each of positioning projections which are included in the connector of FIG. 1. The positioning projection is accommodated in the front recess.

Furthermore, as shown in FIG. 3, each of the upper movable member 180 and the lower movable member 190 has a spring portion 225 and a positioning projection 220. However, the present invention is not limited thereto. The spring portion 225 and the positioning projection 220 may be provided on one of the upper movable member 180 and the lower movable member 190. The spring portion 225 is resiliently deformable and supports the positioning projection 220. The positioning projection 220 projects inward in the up-down direction. The positioning projection 220 is movable in the up-down direction by using resilience of the spring portion 225. As understood from FIGS. 18 and 19, the positioning projection 220 of the present embodiment rides over a gap between the front recess 130 and the rear recess 132 by using resilience of the spring portion 225 to be accommodated in one of the front recess 130 and the rear recess 132 so that the positioning projection 220 relatively positions the screw holding member 160 with respect to the connector main 110 in the predetermined direction.

As understood from FIGS. 1, 13, 14 and 18, in the present embodiment, when the screw holding member 160 is positioned at the front predetermined portion, the front abutment portion 200 abuts against the front facing portion 120 while the positioning projection 220 is accommodated in the front recess 130. In other words, a pair of the front abutment portion 200 and the front facing portion 120 and another pair of the positioning projection 220 and the front recess 130 define the front predetermined position. However, the present invention is not limited thereto. The front predetermined position may be defined only by the pair of the front abutment portion 200 and the front facing portion 120. In addition the front predetermined position may be defined only by the other pair of the positioning projection 220 and the front recess 130. Furthermore, the front predetermined position may be defined by other means.

Figure 15:
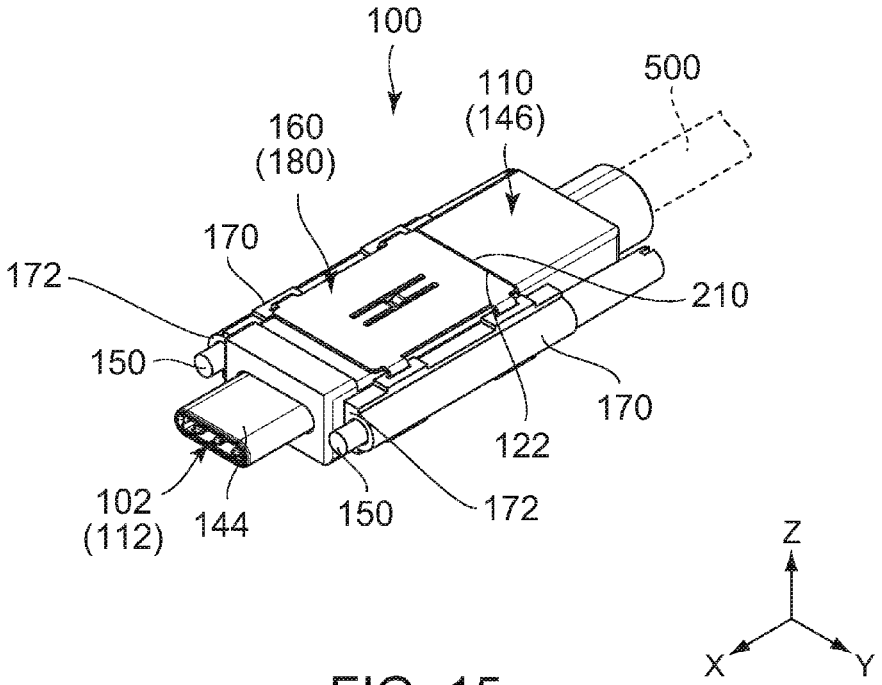
FIG. 15 is yet another top, perspective view showing the connector of FIG. 1.
Figure 16:
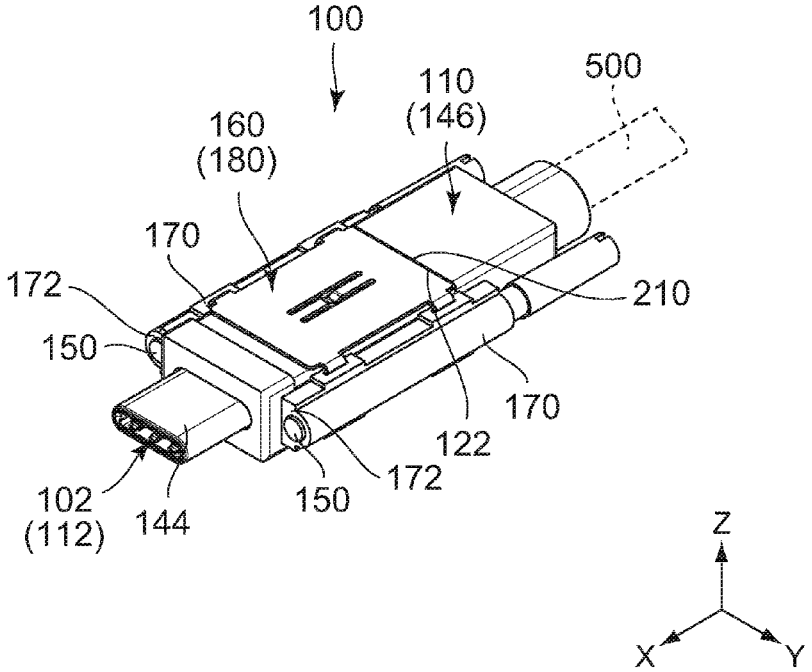
FIG. 16 is still another top, perspective view showing the connector of FIG. 1.
Figure 19:
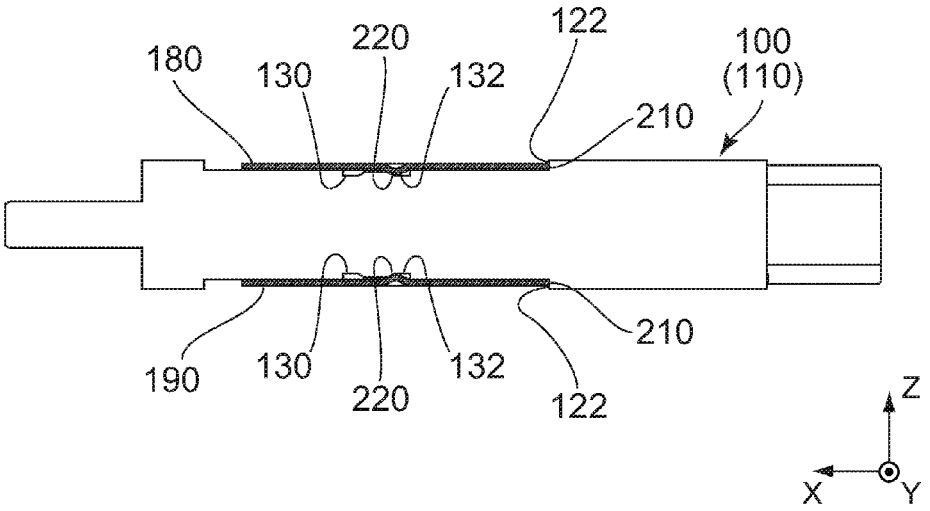
FIG. 19 is a view showing another positional relationship among each of the front recesses, each of the rear recesses and each of the positioning projections which are included in the connector of FIG. 1. The positioning projection is accommodated in the rear recess.

As understood from FIGS. 15, 16 and 19, in the present embodiment, when the screw holding member 160 is positioned at the rear predetermined position, the rear abutment portion 210 abuts against the rear facing portion 122 while the positioning projection 220 is accommodated in the rear recess 132. In other words, a pair of the rear abutment portion 210 and the rear facing portion 122 and another pair of the positioning projection 220 and the rear recess 132 define the rear predetermined position. However, the present invention is not limited thereto. The rear predetermined position may be defined only by the pair of the rear abutment portion 210 and the rear facing portion 122. In addition, the rear predetermined position may be defined only by the other pair of the positioning projection 220 and the rear recess 132. Furthermore, the rear predetermined position may be defined by other means.

Figure 20:
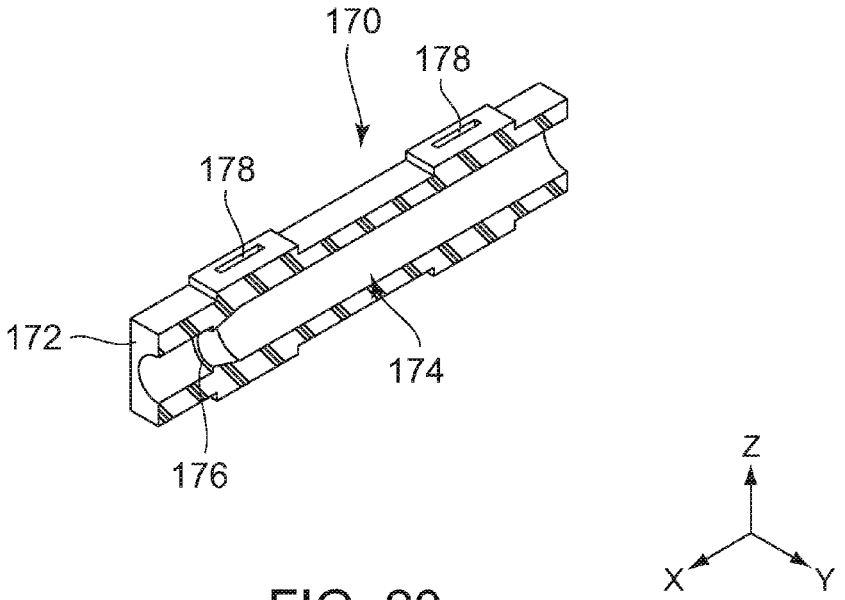
FIG. 20 is a cross-sectional, perspective view showing a screw accommodation member which is included in the connector of FIG. 1.

As understood from FIGS. 1, 3, 21 and 22, each of the screw accommodation members 170 partially accommodates the male screw member 150 and holds the male screw member 150. As shown in FIG. 20, in detail, the screw accommodation member 170 is provided with a male screw seat 172, an accommodation portion 174 and a projecting portion 176. As understood from FIGS. 4 and 5, the male screw seat 172 is a surface which is brought into contact with the female screw seat 340 when the male screw member 150 is connected with the female screw portion 330. As shown in FIG. 20, the male screw seat 172 of the present embodiment is a front surface of the screw accommodation member 170. The accommodation portion 174 extends in the predetermined direction and partially accommodates the male screw member 150. The projecting portion 176 projects into the accommodation portion 174 in a plane perpendicular to the predetermined direction.

Figure 14:
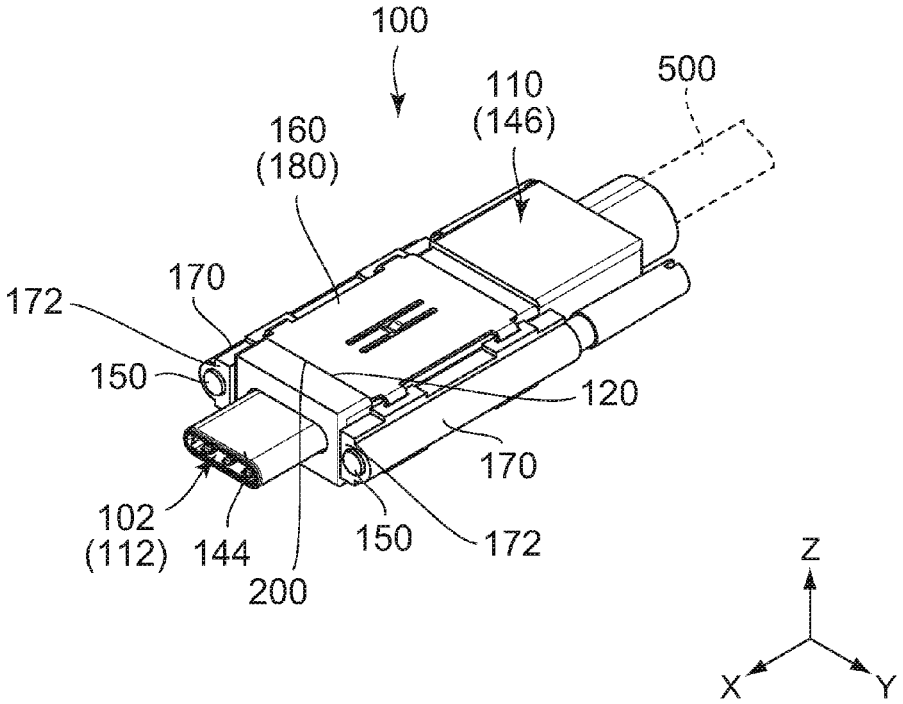
FIG. 14 is another top, perspective view showing the connector of FIG. 1.
Figure 21:
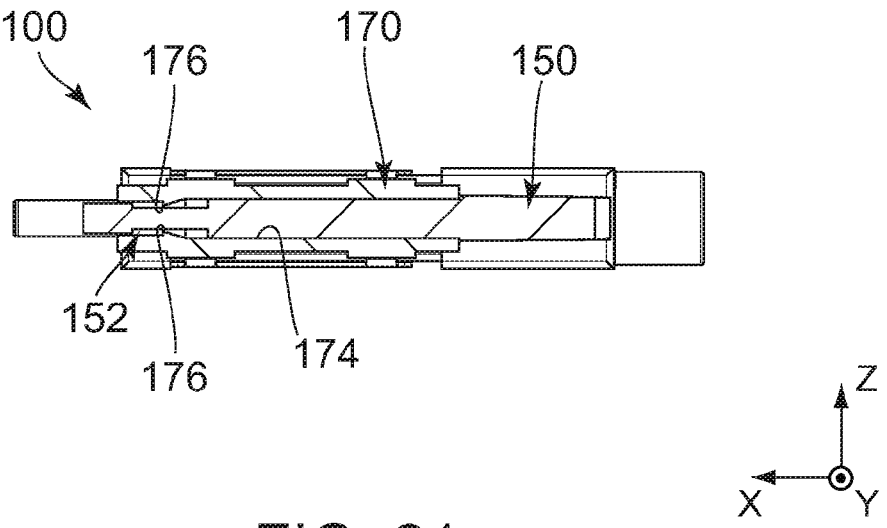
FIG. 21 is a view showing a positional relationship between a male screw member and the screw accommodation member which are included in the connector of FIG. 1.
Figure 22:
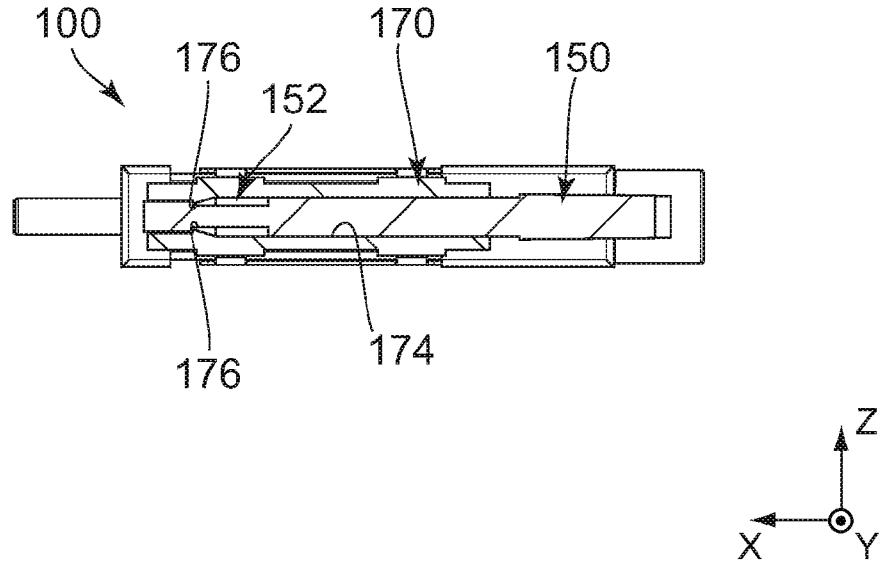
FIG. 22 is a view showing another positional relationship between the male screw member and the screw accommodation member which are included in the connector of FIG. 1.

As understood from FIGS. 1 and 14, in the present embodiment, the male screw member 150 is relatively movable along the predetermined direction with respect to the screw holding member 160. As shown in FIG. 3, in detail, the male screw member 150 is formed with a recess 152 which is recessed in a direction perpendicular to the predetermined direction. As shown in FIGS. 21 and 22, under a state where the male screw member 150 is partially accommodated in the accommodation portion 174, the projecting portion 176 is accommodated in the recess 152. In the predetermined direction, the recess 152 has a size far greater than a size of the projecting portion 176. Accordingly, as shown in FIGS. 1 and 14, the male screw member 150 is relatively movable along the predetermined direction with respect to the screw holding member 160. Thus, a total sum of a movable distance of the male screw member 150 can be increased.

In the present embodiment, the front predetermined position and the rear predetermined position satisfy the following conditions: [condition 1] when the screw holding member 160 is positioned at the front predetermined position, the end 112 of the connector main 110 faces the inner wall 314 of the first fitting portion 310 but does not reach the inner wall 314 under a state where the male screw member 150 is connected with the female screw portion 330 and where the male screw seat 172 is brought into contact with the female screw seat 340; and [condition 2] when the screw holding member 160 is positioned at the rear predetermined position, under a state where the connector 100 is connected with the second connecting object 400, the end 112 of the connector main 110 is able to reach the inner wall 450 of the second fitting portion 430. In other words, when the end 112 of the connector main 110 reaches the inner wall 450 of the second fitting portion 430 under a state where the connector 100 is connected with the second connecting object 400, the screw holding member 160 may be positioned at the rear predetermined position, or may not reach the rear predetermined position and is positioned forward of the rear predetermined position.

Under the condition 1, a distance between the end 112 of the connector main 110 and the inner wall 314 of the first fitting portion 310 is arranged so that the end 112 of the connector main 110 does not just reach the inner wall 314 of the first fitting portion 310 when each of the connector 100 and the first connecting object 300 has maximum tolerance. Accordingly, even if each of the connector 100 and the first connecting object 300 has maximum tolerance, the end 112 of the connector main 110 can be prevented from applying unnecessary stress to the inner wall 314 of the first fitting portion 310.

The condition 2 enables the end 112 of the connector main 110 to securely reach the inner wall 450 of the second fitting portion 430. In other words, the connector 100 and the mating connector (receptacle) 420 which is included in the second connecting object 400 can be properly connected with each other.

As described above, the connector 100 of the present embodiment is provided with the regulating portion and the regulated portion. Accordingly, even if the cable 500 connected to the connector 100 is pulled rearward under a state where the male screw members 150 are connected with the female screw portions 330, respectively, the connector main 110 can be prevented from being removed from the screw holding member 160.

Second Embodiment

Figure 23:
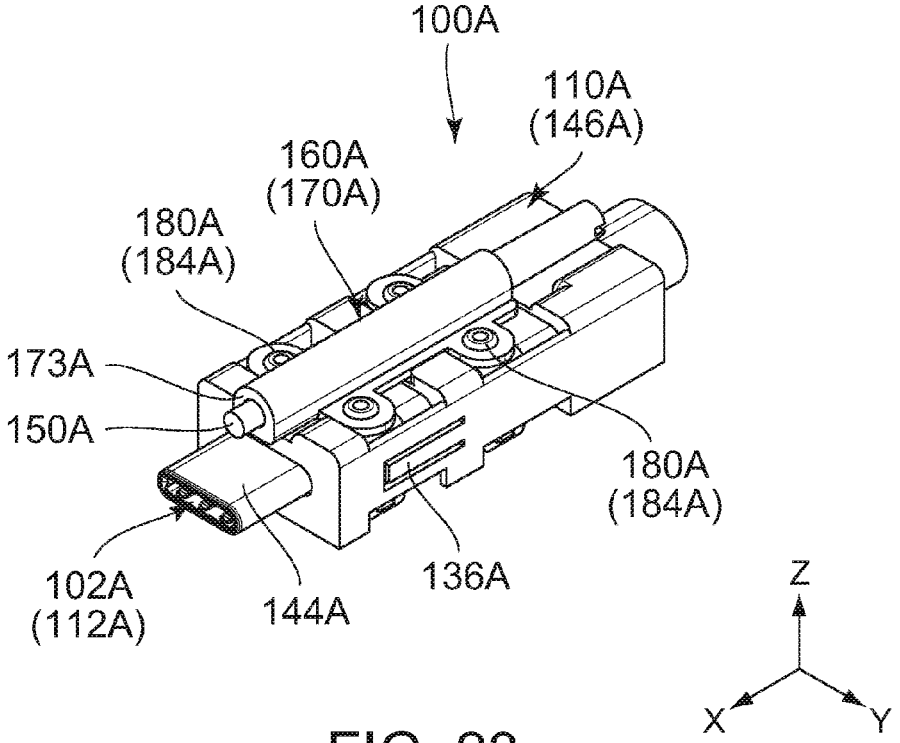
FIG. 23 is a top, perspective view showing a connector according to a second embodiment of the present invention.

Referring to FIG. 23, a connector 100A according to a second embodiment of the present invention is a plug which is in accordance with USB Type-C Standard. As shown in FIG. 23, the connector 100A of the present embodiment has a front end 102A in a predetermined direction. The connector 100A of FIG. 23 is mateable, along the predetermined direction, with not only a first connecting object 300A of FIG. 26 but also the second connecting object 400 of FIG. 11. That is, the connector 100A of the present embodiment is selectively mateable with the first connecting object 300A and the second connecting object 400 along the predetermined direction. Because the second connecting object 400 is same as that of the first embodiment, explanation thereof is omitted. In the present embodiment, the predetermined direction is the X-direction. Furthermore, in the present embodiment, the positive X-direction is the forward direction while the negative X-direction is the rearward direction. In the present embodiment, a lateral direction is the Y-direction while an up-down direction is a Z-direction. A positive Z-direction is an upward direction while a negative direction is a downward direction.

Figure 26:
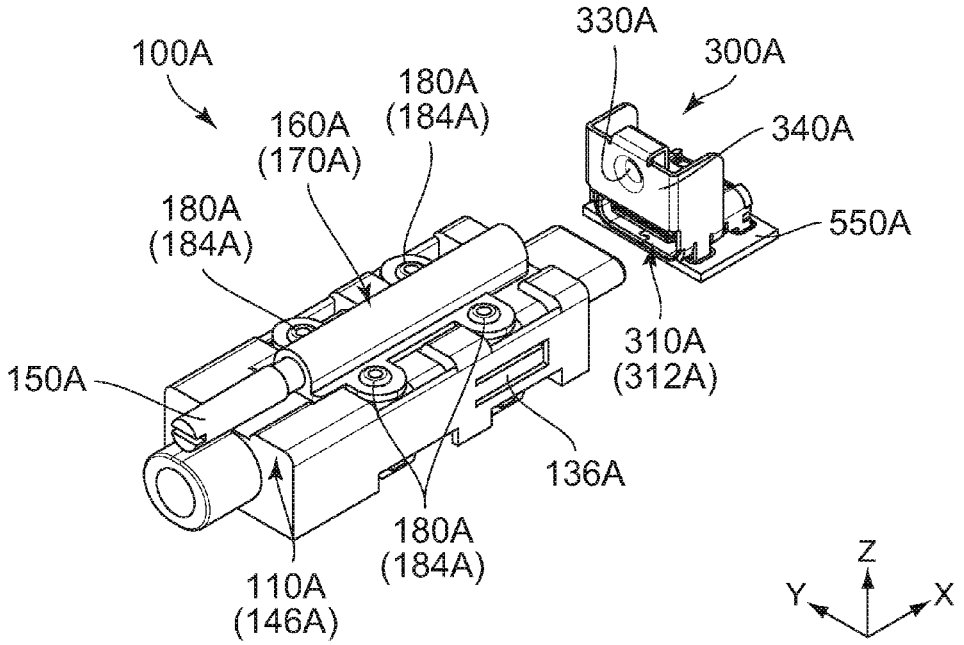
FIG. 26 is a top, perspective view showing the connector of FIG. 23 and a first connecting object. The illustrated connector is not connected with the illustrated first connecting object.
Figure 27:
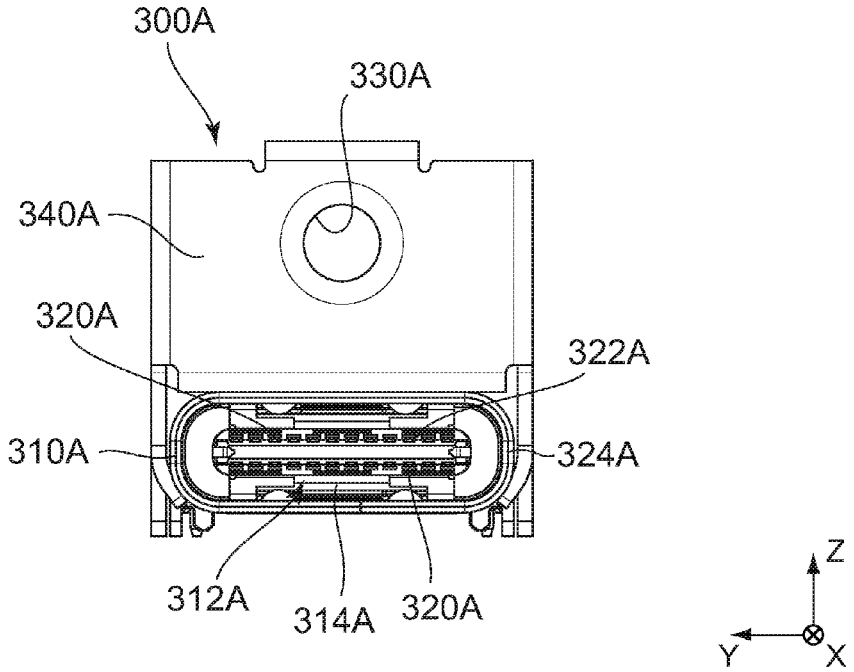
FIG. 27 is a front view showing the first connecting object of FIG. 26.

As shown in FIGS. 26 and 27, in the present embodiment, the first connecting object 300A is a mating connector connectable with the connector 100A and more specifically, is a receptacle being in accordance with USB Type-C Standard. As shown in FIG. 26, the first connecting object 300A is mounted on and fixed to a circuit board 550A. As shown in FIG. 27, the first connecting object 300A is provided with a first fitting portion 310A, a single female screw portion 330A and a single female screw seat 340A. In other words, the first connecting object 300A of the present embodiment is the receptacle having the female screw portion 330A. The first fitting portion 310A has a receiving portion 312A. The receiving portion 312A has an inner wall 314A in the predetermined direction. The female screw portion 330A is positioned above the first fitting portion 310A. Specifically, the first fitting portion 310A is provided with mating contacts 320A, a mating holding member 322A and a mating shell 324A. The mating holding member 322A holds the mating contacts 320A. The mating shell 324A surrounds the mating holding member 322A.

As shown in FIG. 23, the connector 100A includes a connector main 110A, a single male screw member 150A and a screw holding member 160A. The male screw member 150A is positioned above the connector main 110A in the up-down direction.

Figure 24:
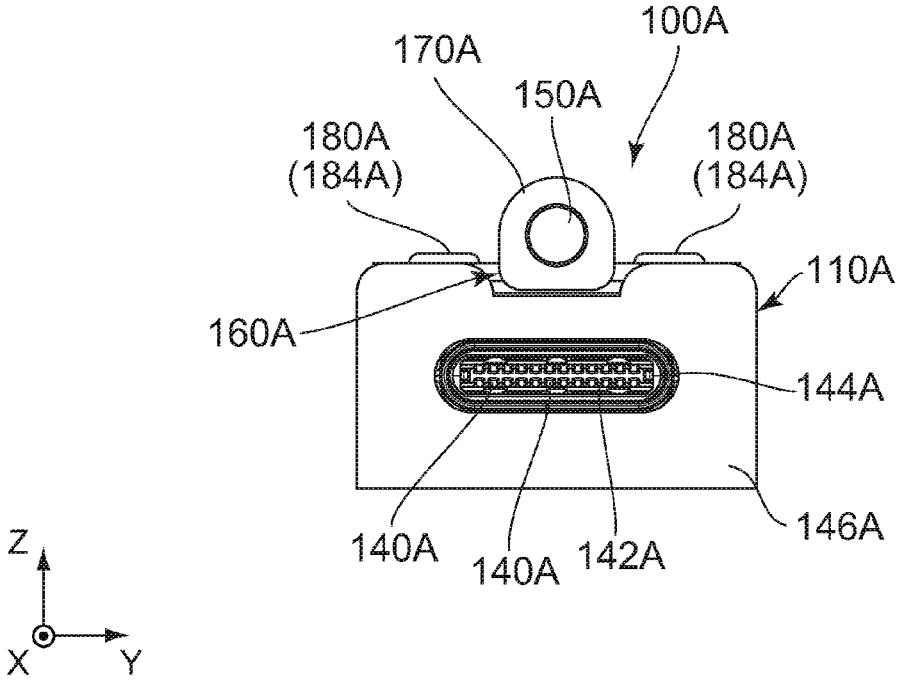
FIG. 24 is a front view showing the connector of FIG. 23.

As shown in FIG. 24, the connector main 110A includes contacts 140A, a holding member 142A, a shell 144A and a hood 146A similar to the first embodiment.

The holding member 142A holds the contacts 140A. The shell 144A surrounds the holding member 142D. Explanation about those components is omitted.

As understood from FIGS. 23 to 28, an end 112A of the connector main 110A forms a front end 102A of the connector 100A. The connector main 110 A is selectively mateable with the first fitting portion 310A of FIG. 26 and the second fitting portion 430 of FIG. 11 along the predetermined direction. As understood from FIGS. 26 and 27, when the connector 100A is connected with the first connecting object 300A, the connector main 110A is received in the receiving portion 312A of the first fitting portion 310A in part.

Figure 25:
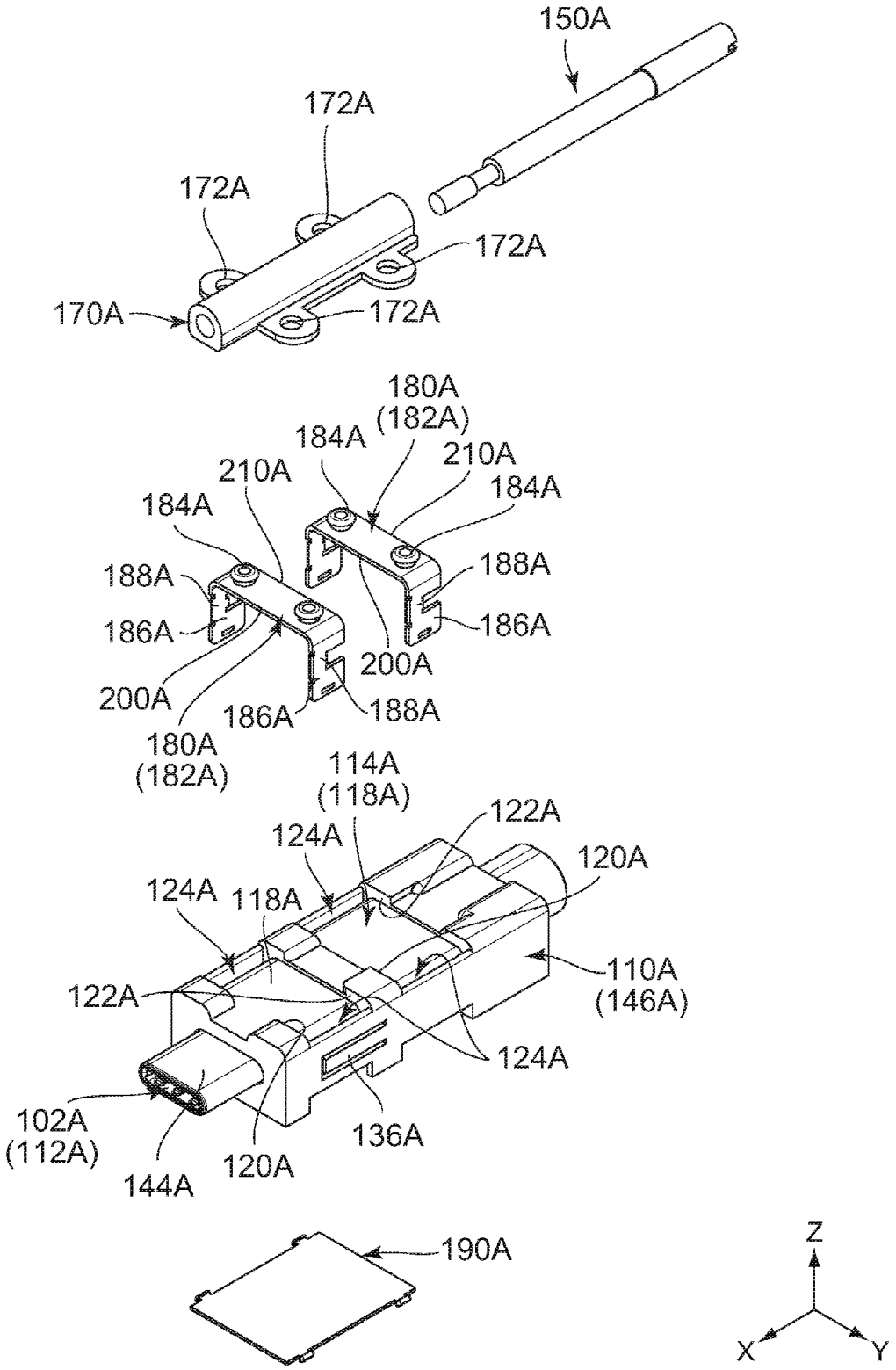
FIG. 25 is an exploded, perspective view showing the connector of FIG. 23.

As shown in FIG. 25, an upper surface 114A of the connector main 110A is provided with two slide surfaces 118A and two pairs each of which consists of a front facing portion 120A and a rear facing portion 122A. The two slide surfaces 118A correspond to the two pairs, respectively, of the front facing portions 120A and the rear facing portions 122A. In other words, the upper surface 114A is provided with two sets of a slide surface 118A, a front facing portion 120A and a rear facing portion 122A. However, the present invention is not limited thereto. The upper surface 114A of the connector main 110A may be provided only with the single slide surface 118A and a single pair of the front facing portion 120A and the rear facing portion 122A. In the predetermined direction, each of the slide surfaces 118A is positioned between the front facing portion 120A and the rear facing portion 122A of the corresponding pair. Each of the front facing portions 120A is a wall which is positioned forward of the corresponding slide surface 118A and which stands in the up-down direction. Each of the rear facing portions 122A is a wall which is positioned rearward of the corresponding slide surface 118A and which stands in the up-down direction. In the present embodiment, each of the slide surfaces 118A, the front facing portions 120A and the rear facing portions 122A is formed on the hood 146A. Each of the front facing portions 120A functions as a regulated portion as described later.

Figure 29:
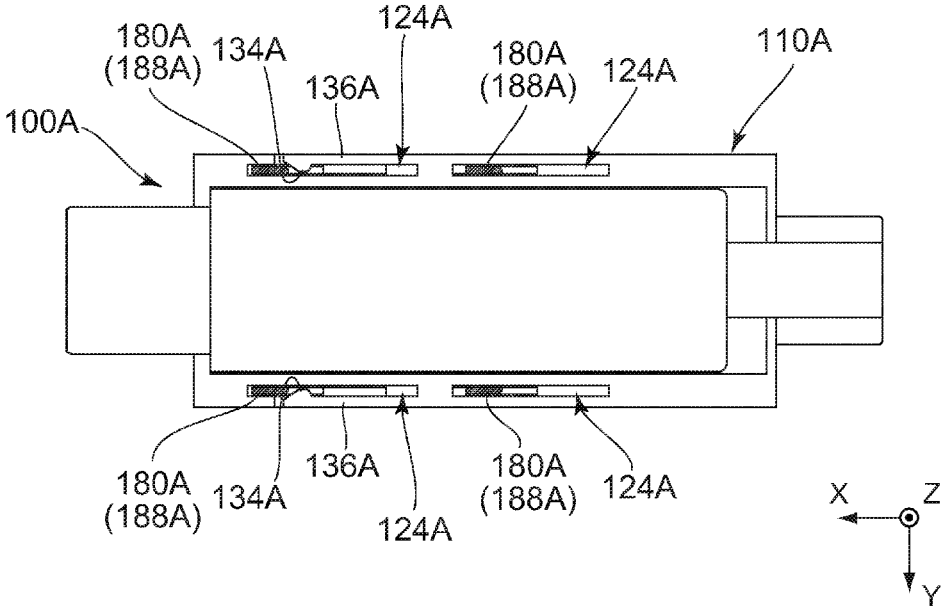
FIG. 29 is a view showing a positional relationship between each of positioning projections and each of positioned portions which are included in the connector of FIG. 23.
Figure 30:
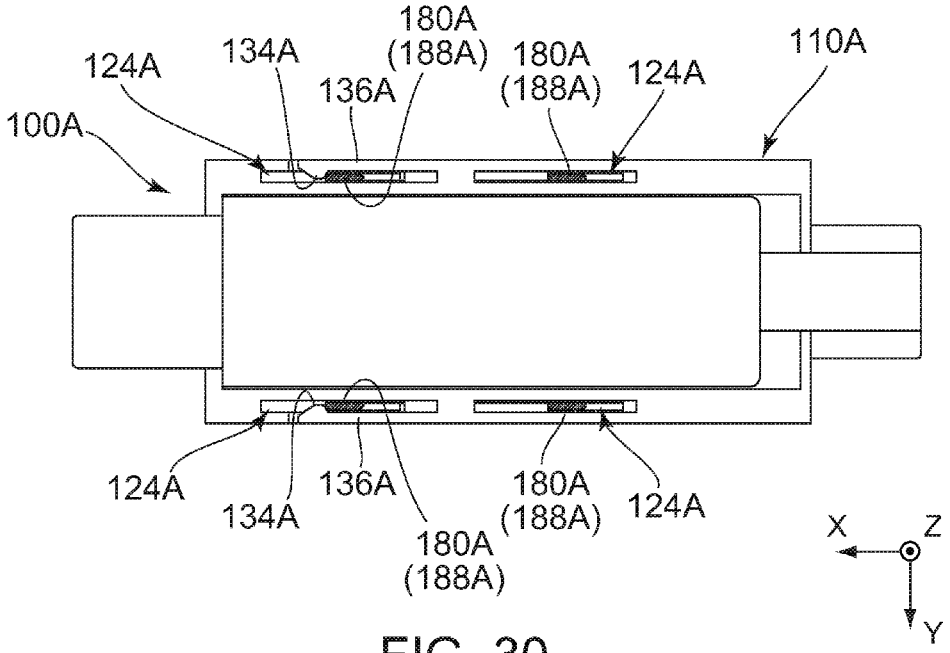
FIG. 30 is a view showing another positional relationship between each of the positioning projections and each of the positioned portions which are included in the connector of FIG. 23.

As understood from FIGS. 25, 29 and 30, the connector main 110A has two pairs, each of which consists of two ditches 124A, a pair of two spring portions 136A and a pair of two positioning projections 134A. Each of the ditches 124A extends in the predetermined direction. The two spring portions 136A correspond to the two positioning projections 134A, respectively. However, the present invention is not limited thereto. The connector main 110A may only have a single pair of the two ditches 124A, the pair of the two spring portions 136A and the pair of the two positioning projections 134A. The two spring portions 136A are provided in the two ditches 124A, respectively. Each of the spring portions 136A is resiliently deformable and supports the corresponding positioning projection 134A. Each of the positioning projections 134A projects into the corresponding ditch 124A in the lateral direction. Each of the positioning projections 134A is movable in the lateral direction by using resilience of the corresponding spring portion 136A. In the present embodiment, the ditches 124A and the positioning projections 134A are formed on the hood 146A.

Figure 28:
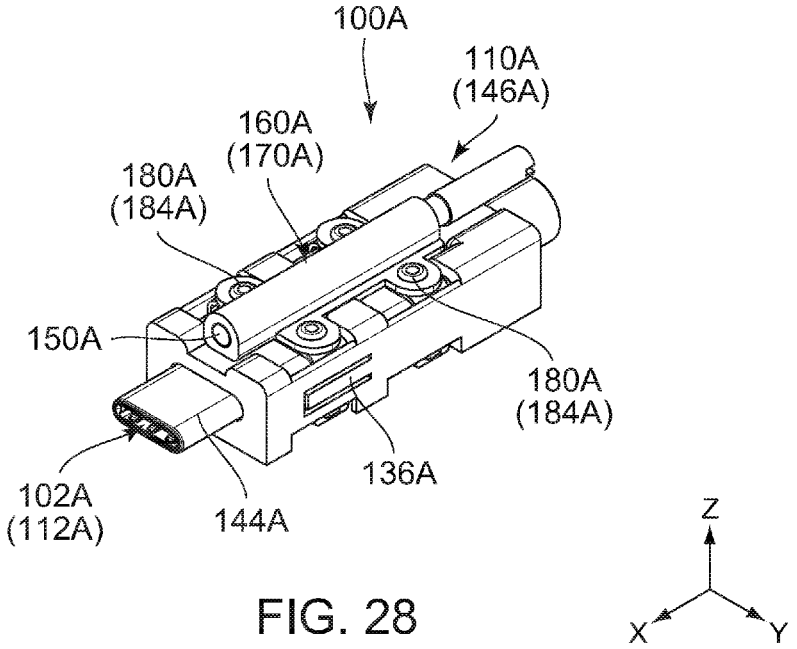
FIG. 28 is another top, perspective views showing the connector of FIG. 23.

As shown in FIGS. 23 and 28, the screw holding member 160A is attached to the connector main 110A and is relatively movable along the predetermined direction with respect to the connector main 110A between a front predetermined position and a rear predetermined position.

As shown in FIG. 25, in detail, the screw holding member 160A of the present embodiment includes an upper accommodation member 170A, two movable members 180A and a lower plate 190A. As shown in FIG. 23, the upper accommodation member 170A is provided with a male screw seat 173A. As understood from FIG. 26, the male screw seat 173A is a surface which is brought into contact with the female screw seat 340A when the male screw member 150A is connected with the female screw portion 330A. As shown in FIG. 23, the male screw seat 173A of the present embodiment is a front surface of the upper accommodation member 170A. As shown in FIGS. 29 and 30, each of the movable members 180A corresponds to the aforementioned ditches 124A and the positioning projections 134A. The screw holding member 160A may have the single movable member 180A. As understood from FIGS. 23 to 25, the upper accommodation member 170A is positioned above the connector main 110A and partially accommodates the male screw member 150A. The upper accommodation member 170A accommodates the male screw member 150A in a manner similar to a manner in which the screw accommodation member 170 of the aforementioned first embodiment accommodates the male screw member 150.

As understood from FIGS. 25, 29 and 30, each of the movable members 180A is held by the connector main 110A so as to be movable in the predetermined direction. As shown in FIG. 25, each of the movable members 180A has an upper portion 182A and side portions 186A. The upper portion 182A is attached to the upper accommodation member 170A. Each of the side portions 186A extends downward in the up-down direction from the upper portion 182A. In the present embodiment, the upper portion 182A is formed with two projections 184A, and the upper accommodation member 170A is formed with holes 172A. As understood from FIGS. 23 and 25, the projections 184A of the upper portions 182A are inserted into the holes 172A of the upper accommodation member 170A and are then crimped, so that the upper accommodation member 170A is fixed to the movable members 180A.

As understood from FIGS. 23, 25 and 28, the upper portions 182A of the movable members 180A are slidable on the slide surfaces 118A, respectively. As shown in FIG. 25, each of the upper portions 182A has a front abutment portion 200A and a rear abutment portion 210A. In the present embodiment, the front abutment portion 200A is a front edge of the upper portion 182A, and the rear abutment portion 210A is a rear edge of the upper portion 182A. As understood from FIGS. 23, 25 and 28, each of the front abutment portions 200A faces the front facing portion 120A corresponding thereto in the predetermine direction and is positioned rearward of the front facing portion 120A corresponding thereto. In addition, each of the rear abutment portions 210A faces the rear facing portion 122A corresponding thereto in the predetermine direction and is positioned forward of the rear facing portion 122A corresponding thereto. Accordingly, the front facing portion 120A regulates a forward movement of the front abutment portion 200A beyond the front facing portion 120A in the predetermined direction. Similarly, the rear facing portion 122A regulates a rearward movement of the rear abutment portion 210A beyond the rear facing portion 122A in the predetermined direction.

As understood from above, the front abutment portion 200A of the present invention functions as a regulating portion for the front facing portion (regulated portion) 120A. The regulating portion regulates a rearward movement of the regulated portion beyond the regulating portion in the predetermined direction.

Furthermore, the side portions 186A of each of the movable members 180A are, at least in part, accommodated in the ditches 124A of the connector main 110A. A lower end of each of the side portions 186A projects downward of the connector main 110A, and the lower ends of the side portions 186A are coupled with each other by the lower plate 190A.

As shown in FIG. 25, each of the side portions 186A is provided with a positioned portion 188A. As understood from FIGS. 29 and 30, when the movable member 180A is moved along the predetermined direction, the positioned portions 188A ride over the positioning projections 134A which are supported by the spring portions 136A, respectively. The movable member 180A is positioned in the predetermined direction by positioning each of the positioned portions 188A forward or rearward of the corresponding positioning projection 134A.

As understood from FIGS. 23, 25 and 29, in the present embodiment, when the screw holding member 160A is positioned at the front predetermined portion, the front abutment portion 200A abuts against the front facing portion 120A while the positioning projection 134A is positioned rearward of the positioned portion 188A. In other words, a pair of the front abutment portion 200A and the front facing portion 120A and another pair of the positioning projection 134A and the positioned portion 188A define the front predetermined position. However, the present invention is not limited thereto. The front predetermined position may be defined only by the pair of the front abutment portion 200A and the front facing portion 120A. In addition, the front predetermined position may be defined only by the other pair of the positioning projection 134A and the positioned portion 188A. Furthermore, the front predetermined position may be defined by other means.

As understood from FIGS. 25, 28 and 30, in the present embodiment, when the screw holding member 160A is positioned at the rear predetermined portion, the rear abutment portion 210A abuts against the rear facing portion 122A while the positioning projection 134A is positioned forward of the positioned portion 188A. In other words, a pair of the rear abutment portion 210A and the rear facing portion 122A and another pair of the positioning projection 134A and the positioned portion 188A define the rear predetermined position. However, the present invention is not limited thereto. The rear predetermined position may be defined only by the pair of the rear abutment portion 210A and the rear facing portion 122A. In addition, the rear predetermined position may be defined only by the other pair of the positioning projection 134A and the positioned portion 188A. Furthermore, the rear predetermined position may be defined by other means.

In the present embodiment, the front predetermined position is arranged to satisfy the condition 1 described in the first embodiment, and the rear predetermined position is arranged to satisfy the condition 2 described in the first embodiment. Accordingly, the connector 100A of the present embodiment also has an effect similar to that of the first embodiment.

Third Embodiment

Figure 31:
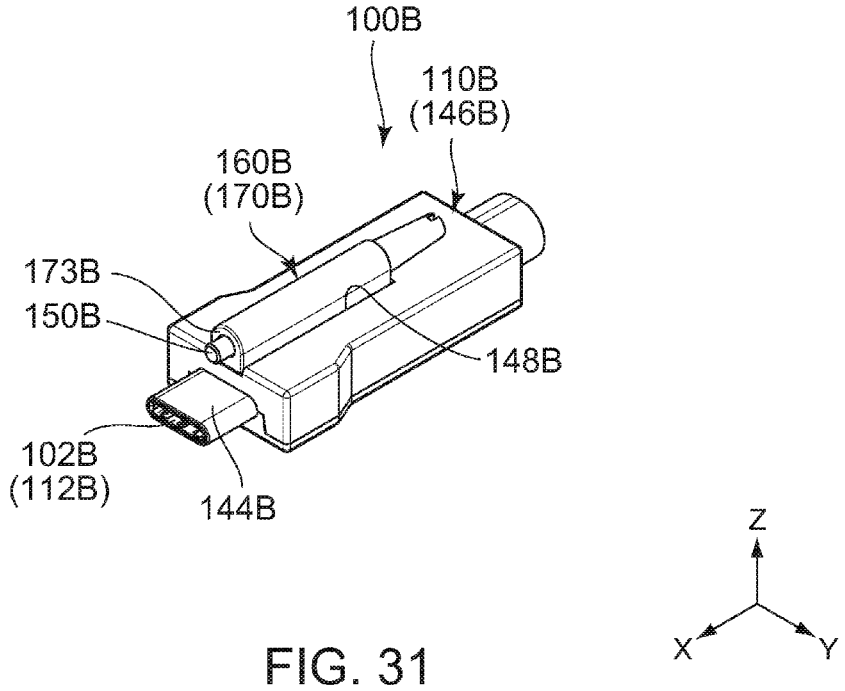
FIG. 31 is a top, perspective view showing a connector according to a third embodiment of the present invention.

Referring to FIG. 31, a connector 100B according to a third embodiment of the present invention is a modification of the connector 100A of the second embodiment of FIG. 23 as described above. Specifically, similar to the connector 100A of the second embodiment, the connector 100B is to be connected with the connecting object. Accordingly, explanation about features of the connector 100B in common with the connector 100A of the second embodiment is omitted. In the present embodiment, a predetermined direction, a lateral direction and an up-down direction are the X-direction, the Y-direction and the Z-direction, respectively. In addition, in the present embodiment, the positive X-direction is the forward direction while the negative X-direction is the rearward direction. Furthermore, in the present embodiment, the positive Z-direction is the upward direction while the negative direction is the downward direction.

Figure 32:
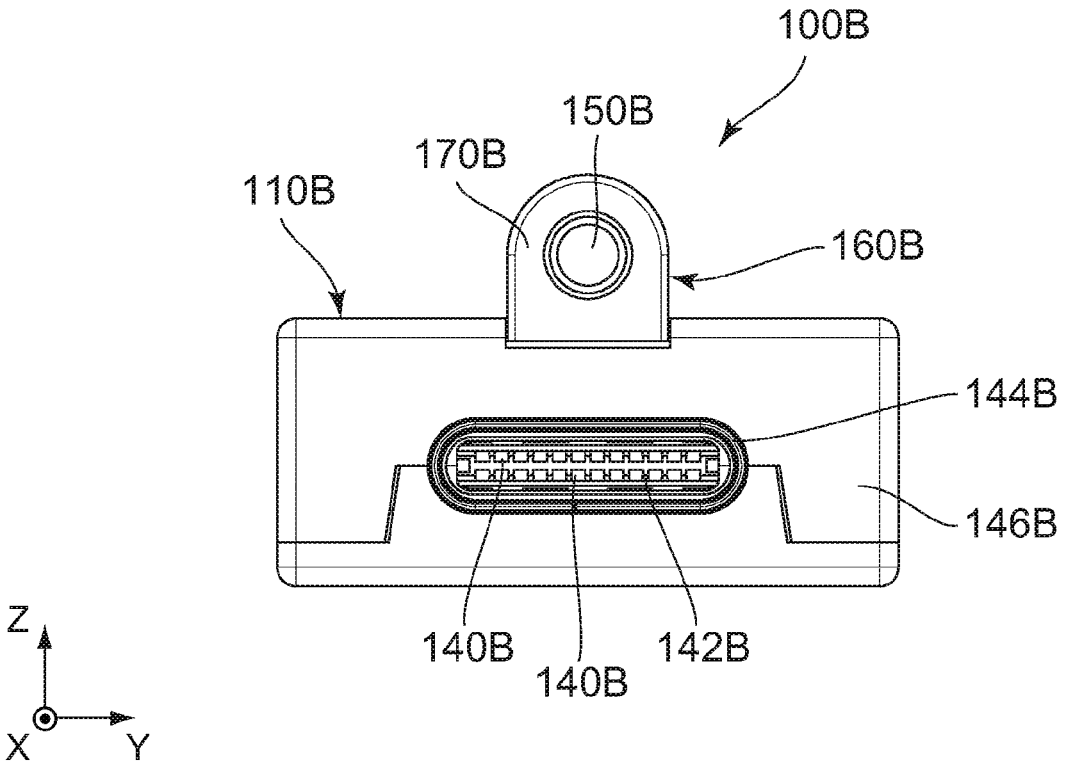
FIG. 32 is a front view showing the connector of FIG. 31.
Figure 33:
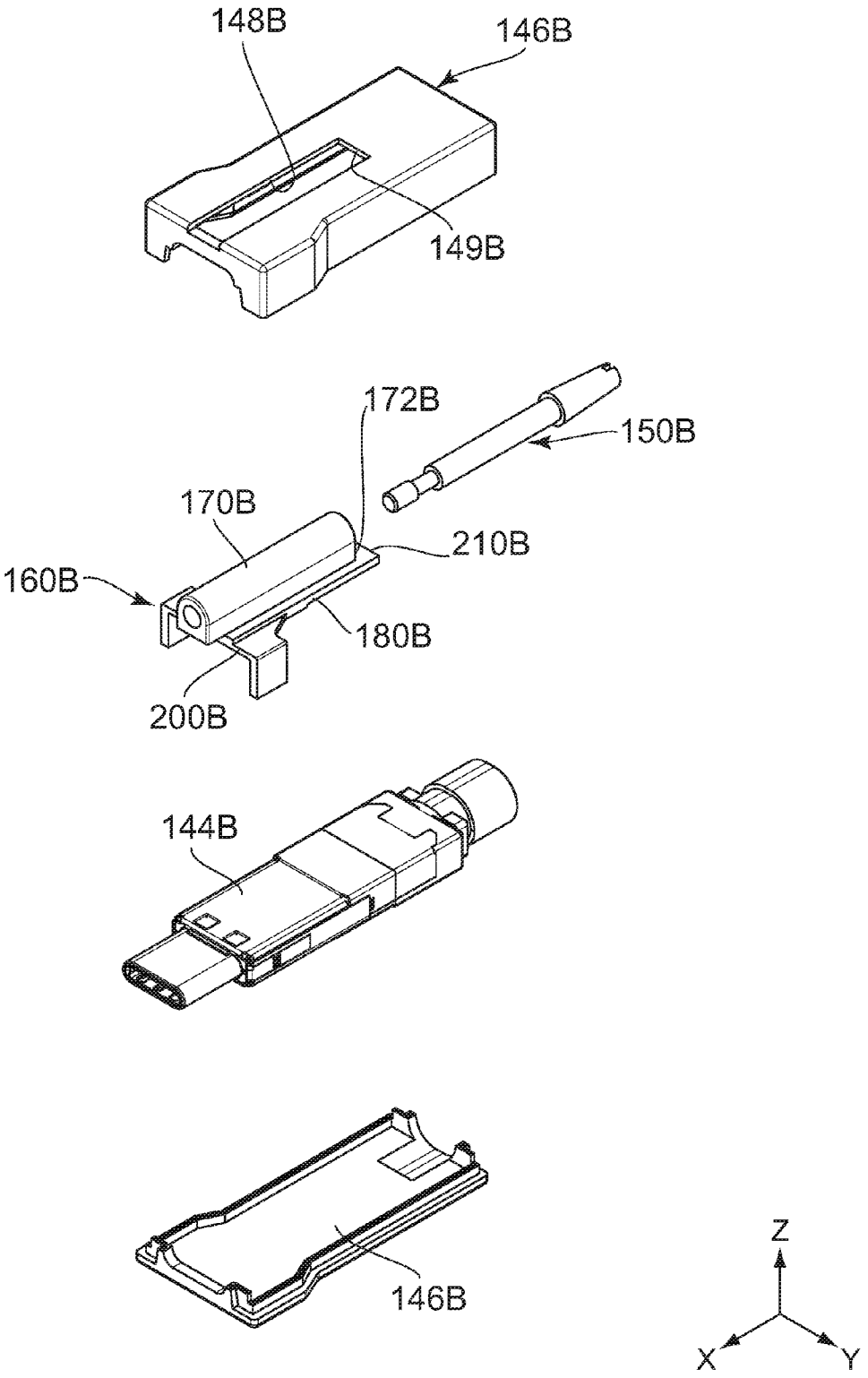
FIG. 33 is an exploded, perspective view showing the connector of FIG. 31.

As understood from FIGS. 31 to 33, the connector 100B includes a connector main 110B, a single male screw member 150B and a screw holding member 160B. The male screw member 150B is positioned above the connector main 110B in the up-down direction.

As shown in FIG. 32, the connector main 110B includes contacts 140B, a holding member 142B, a shell 144B and a hood 146B similar to the first embodiment. The holding member 142B holds the contacts 140B. The shell 144B surrounds the holding member 142B. Explanation about the contacts 140B, the holding member 142B and the shell 144B is omitted.

Figure 35:
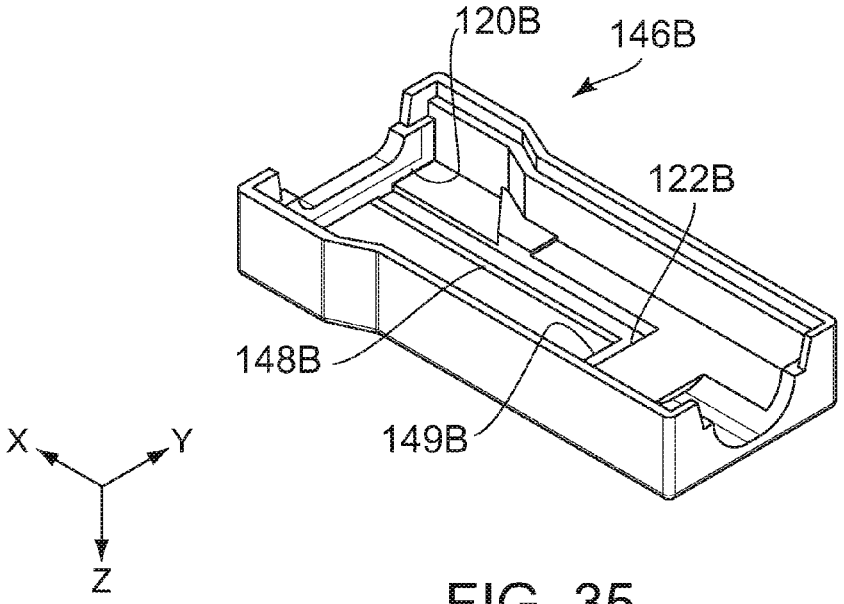
FIG. 35 is a bottom, perspective view showing an upper part of a hood which is included in the connector of FIG. 31.

As shown in FIG. 33, the illustrated hood 146B consists of two parts of an upper part and a lower part. The upper part of the hood 146B is formed with a slot 148B. The slot 148B has a rear edge 149B. As shown in FIG. 35, the upper part of the hood 146B is formed with a front facing portion 120B which is positioned at lateral sides of a front end of the slot 148B, and is formed with a rear facing portion 122B which is positioned in the vicinity of the rear edge 149B of the slot 148B. Each of the front facing portion 120B and the rear facing portion 122B is provided inside the hood 146B. In other words, in the present embodiment, each of the front facing portion 120B and the rear facing portion 122B is provided inside the connector main 110B.

As understood from FIGS. 31 to 33, the screw holding member 160B of the present embodiment is attached to the connector main 110B in a state where the screw holding member 160B is partially accommodated in the connector main 110B. As understood from FIGS. 31, 37 and 38, the screw holding member 160B is relatively movable with respect to the connector main 110B along the predetermined direction between the front predetermined position and the rear predetermined position.

Figure 36:
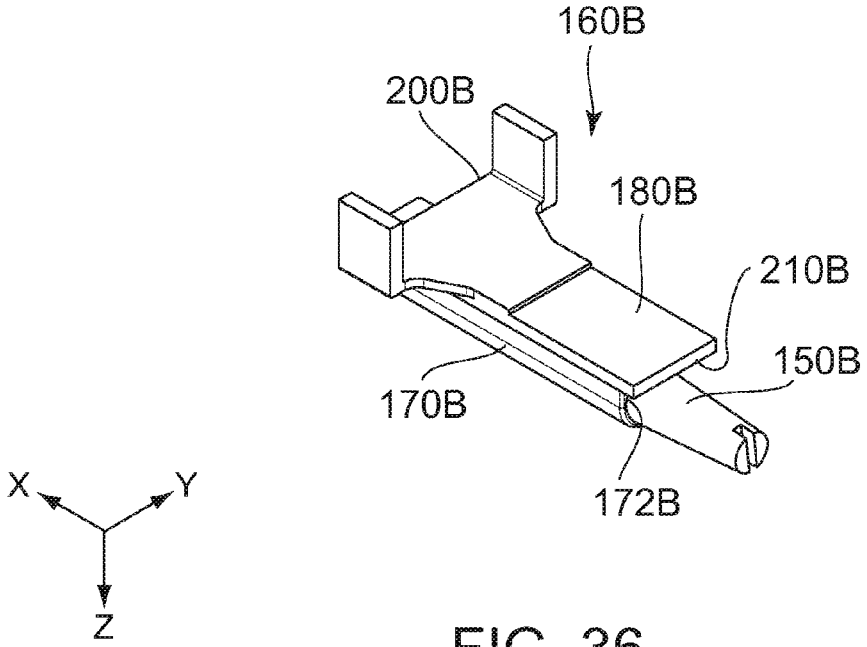
FIG. 36 is a bottom, perspective view showing a screw holding member which is included in the connector of FIG. 31.
Figure 37:
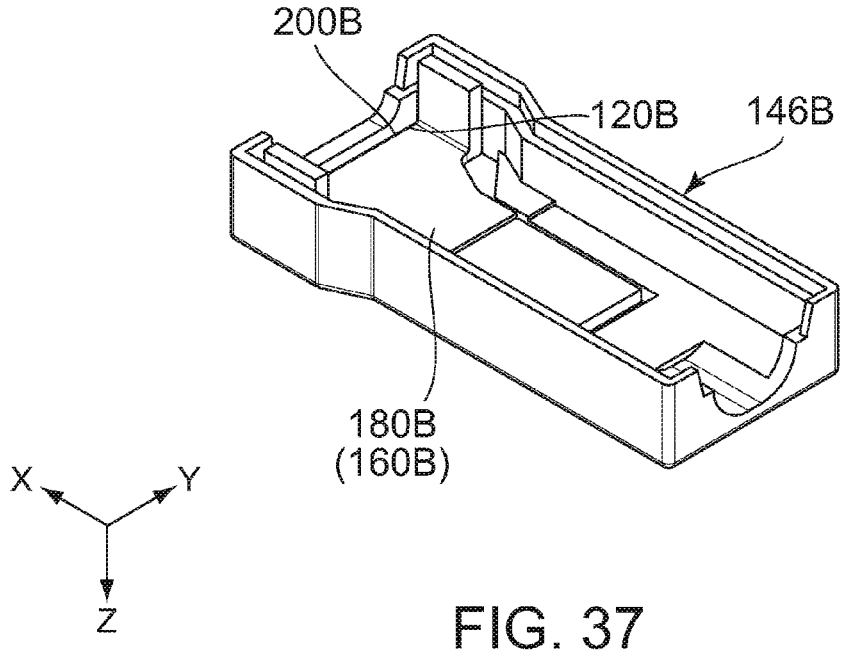
FIG. 37 is a bottom, perspective view showing the upper part of the hood of FIG. 35 and the screw holding member of FIG. 36.
Figure 38:
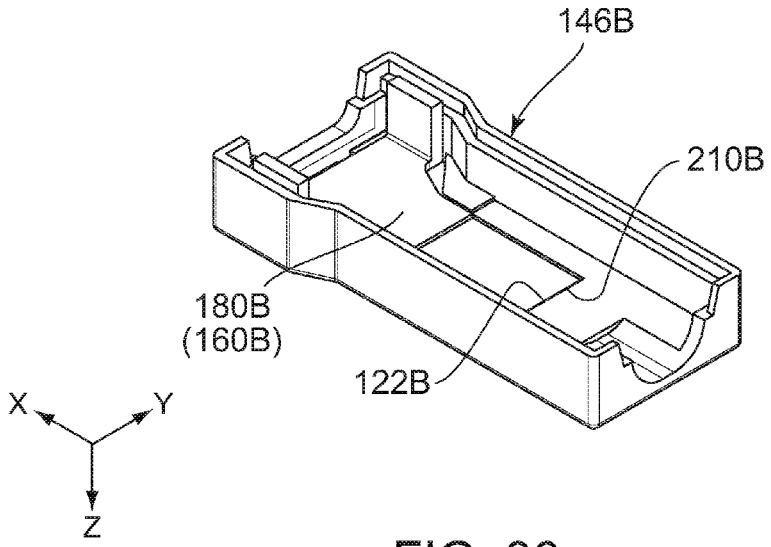
FIG. 38 is another bottom, perspective view showing the upper part of the hood of FIG. 35 and the screw holding member of FIG. 36.

As understood from FIGS. 33 and 36, in detail, the screw holding member 160B of the present embodiment has an upper accommodation portion 170B and a movable portion 180B. The movable portion 180B and the upper accommodation portion 170B of the present embodiment are formed integrally with each other. As shown in FIG. 31, the upper accommodation portion 170B is provided with a male screw seat 173B. As understood from FIGS. 32 and 34, the male screw seat 173B is a surface which is brought into contact with the female screw seat 340A when the male screw member 150B is connected with the female screw portion 330A. As shown in FIG. 32, the male screw seat 173B of the present embodiment is a front end surface of the upper accommodation portion 170B. As understood from FIGS. 31 and 33, the movable portion 180B is accommodated in the connector main 110B so as to be movable in the predetermined direction. As shown in FIG. 36, the movable portion 180B is provided with a front abutment portion 200B and a rear abutment portion 210B. In the present embodiment, the front abutment portion 200B is a front edge of the movable portion 180B, and the rear abutment portion 210B is a rear edge of the movable portion 180B. As shown in FIGS. 37 and 38, the front abutment portion 200B faces the front facing portion 120B in the predetermine direction and is positioned rearward of the front facing portion 120B. In addition, the rear abutment portion 210C faces the rear facing portion 122B in the predetermine direction and is positioned forward of the rear facing portion 122B. Accordingly, the front facing portion 120B regulates a forward movement of the front abutment portion 200B beyond the front facing portion 120B in the predetermined direction. Similarly, the rear facing portion 122B regulates a rearward movement of the rear abutment portion 210B beyond the rear facing portion 122B in the predetermined direction. As understood from above, the front abutment portion 200B of the present embodiment functions as a regulating portion for the front facing portion (regulated portion) 120B.

As understood from FIGS. 31 and 33, the upper accommodation portion 170B is provided on the movable portion 180B and is exposed outside the connector main 110B through the slot 148B. Accordingly, the upper accommodation portion 170B is positioned above the connector main 110B. The upper accommodation portion 170B partially accommodates the male screw member 150B. The upper accommodation portion 170B accommodates the male screw member 150B in a manner similar to a manner in which the screw accommodation member 170 of the aforementioned first embodiment accommodates the male screw member 150. As shown in FIGS. 33 and 36, the upper accommodation portion 170B has a rear end portion 172B. As understood from FIGS. 31 and 33, the rear edge 149B of the slot 148B faces the rear end portion 172B of the upper accommodation portion 170B in the predetermined direction and is positioned rearward of the rear end portion 172B. Accordingly, the rear edge 149B of the slot 148B regulates a rearward movement of the rear end portion 172B of the upper accommodation portion 170B beyond the rear edge 149B of the slot 148B.

As understood from FIG. 37, in the present modification, when the screw holding member 160B is positioned at the front predetermined position, the front abutment portion 200B abuts against the front facing portion 120B. In other words, the front abutment portion 200B and the front facing portion 120B define the front predetermined position. However, the present invention is not limited thereto. The front predetermined position may be defined by other means.

Figure 34:
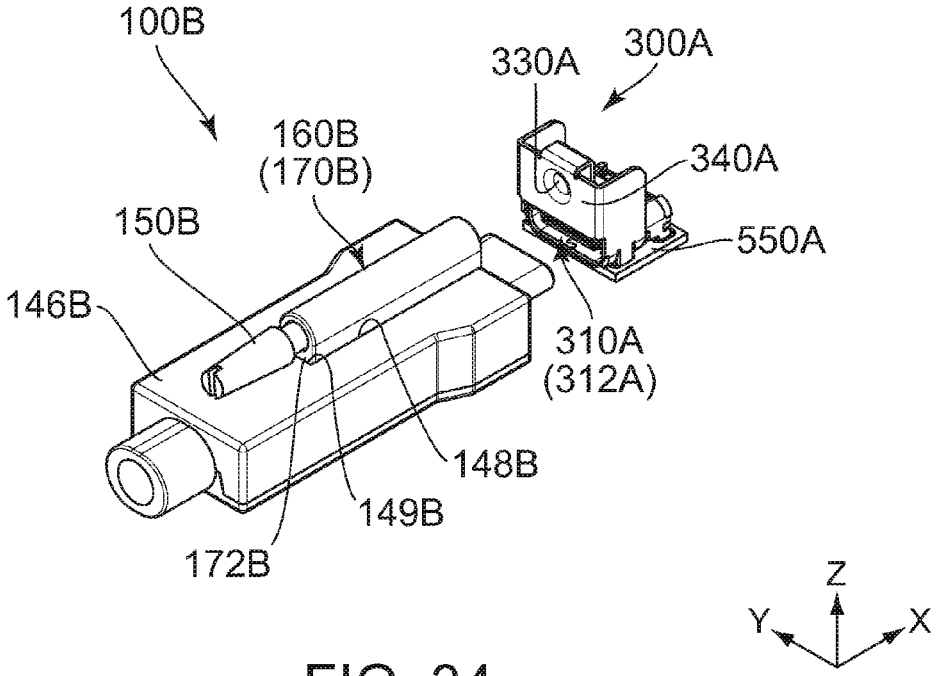
FIG. 34 is a top, perspective view showing the connector of FIG. 31 and the first connecting object. The illustrated connector is not connected with the illustrated first connecting object.

As understood from FIGS. 34 and 38, in the present modification, when the screw holding member 160B is positioned at the rear predetermined position, the rear abutment portion 210B abuts against the rear facing portion 122B while the rear end portion 172B of the upper accommodation portion 170B abuts against the rear edge 149B of the slot 148B. In other words, a pair of the rear abutment portion 210B and the rear facing portion 122B and another pair of the rear end portion 172B of the upper accommodation portion 170B and the rear edge 149B of the slot 148B define the rear predetermined position. However, the present invention is not limited thereto. The rear predetermined position may be defined only by the pair of the rear abutment portion 210B and the rear facing portion 122B. In addition, the rear predetermined position may be defined only by the other pair of the rear end portion 172B of the upper accommodation portion 170B and the rear edge 149B of the slot 148B. Furthermore, the rear predetermined position may be defined by other means.

In the present embodiment, the front predetermined position is arranged to satisfy the condition 1 described in the first embodiment, and the rear predetermined position is arranged to satisfy the condition 2 described in the first embodiment. Accordingly, the connector 100B of the present embodiment also has an effect similar to that of the first embodiment.

Fourth Embodiment

Figure 39:
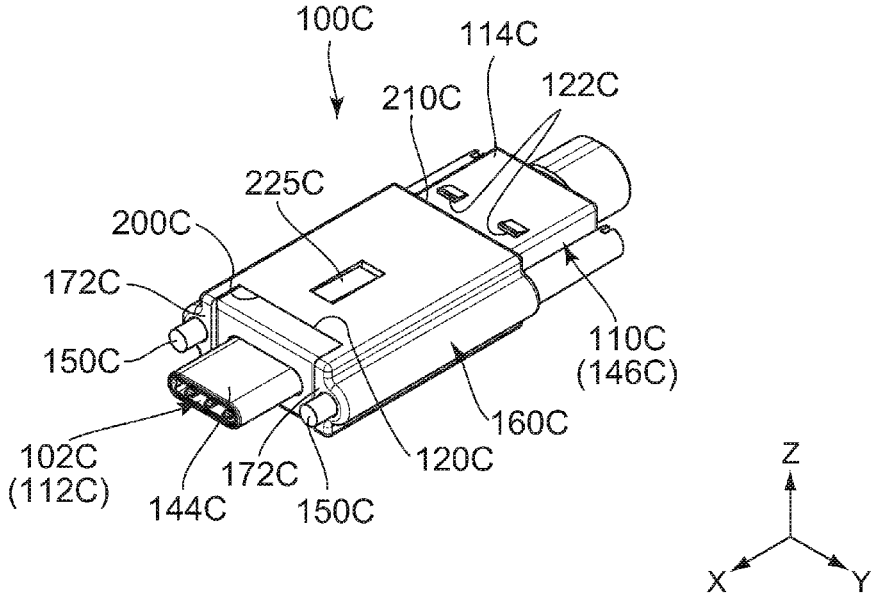
FIG. 39 is a top, perspective view showing a connector according to a fourth embodiment of the present invention.
Figure 40:
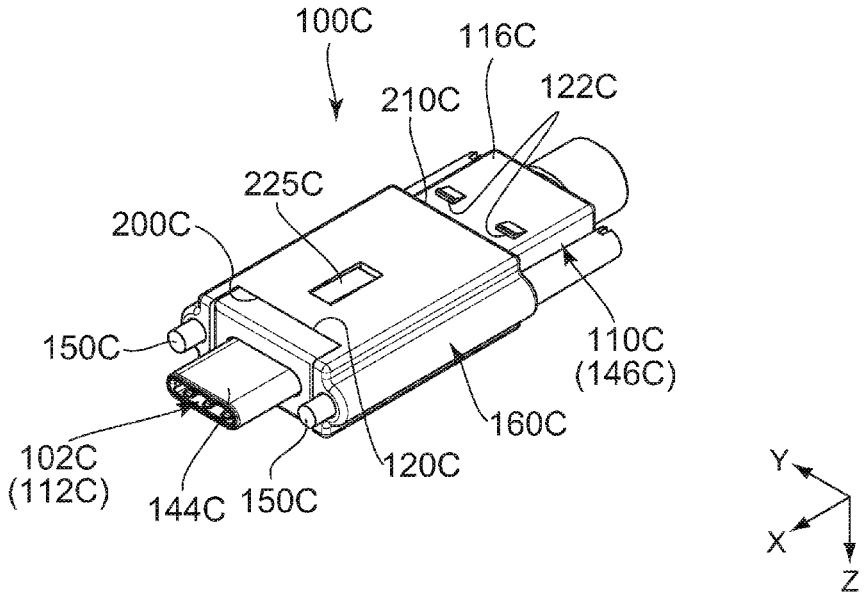
FIG. 40 is a bottom, perspective view showing the connector of FIG. 39.

Referring to FIG. 39, a connector 100C according to a fourth embodiment of the present invention is a modification of the connector 100 of the first embodiment of FIG. 1 as described above. Specifically, similar to the connector 100 of the first embodiment, the connector 100C is to be connected with the connecting object. Accordingly, explanation about features of 100C in common with the connector 100 of the aforementioned first embodiment is omitted. In the present embodiment, a predetermined direction, a lateral direction and an up-down direction are the X-direction, the Y-direction and the Z-direction, respectively. In addition, in the present embodiment, the positive X-direction is the forward direction while the negative X-direction is the rearward direction. Furthermore, in the present embodiment, the positive Z-direction is the upward direction while the negative direction is the downward direction.

Figure 41:
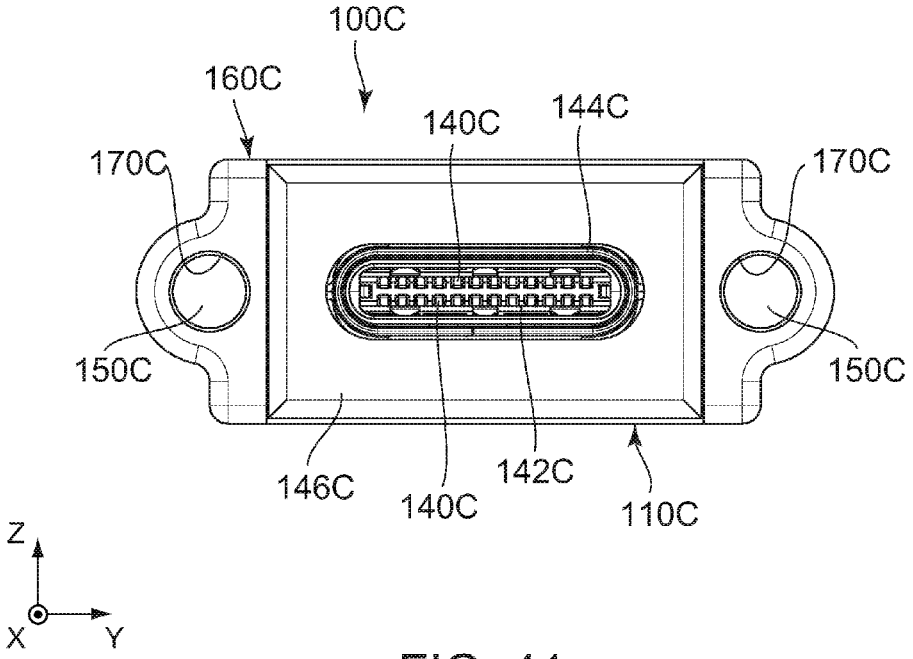
FIG. 41 is a front view showing the connector of FIG. 39.

As shown in FIGS. 39 to 43, the connector 100C includes a connector main 110C, two male screw members 150C and a screw holding member 160C. The connector main 110C is positioned between the two male screw members 150C in the lateral direction. As shown in FIG. 41, the connector main 110C includes contacts 140C, a holding member 142C, a shell 144C and a hood 146C similar to the first embodiment. The holding member 142C holds the contacts 140C. The shell 1440 surrounds the holding member 142C. Explanation about those components is omitted.

Figure 42:
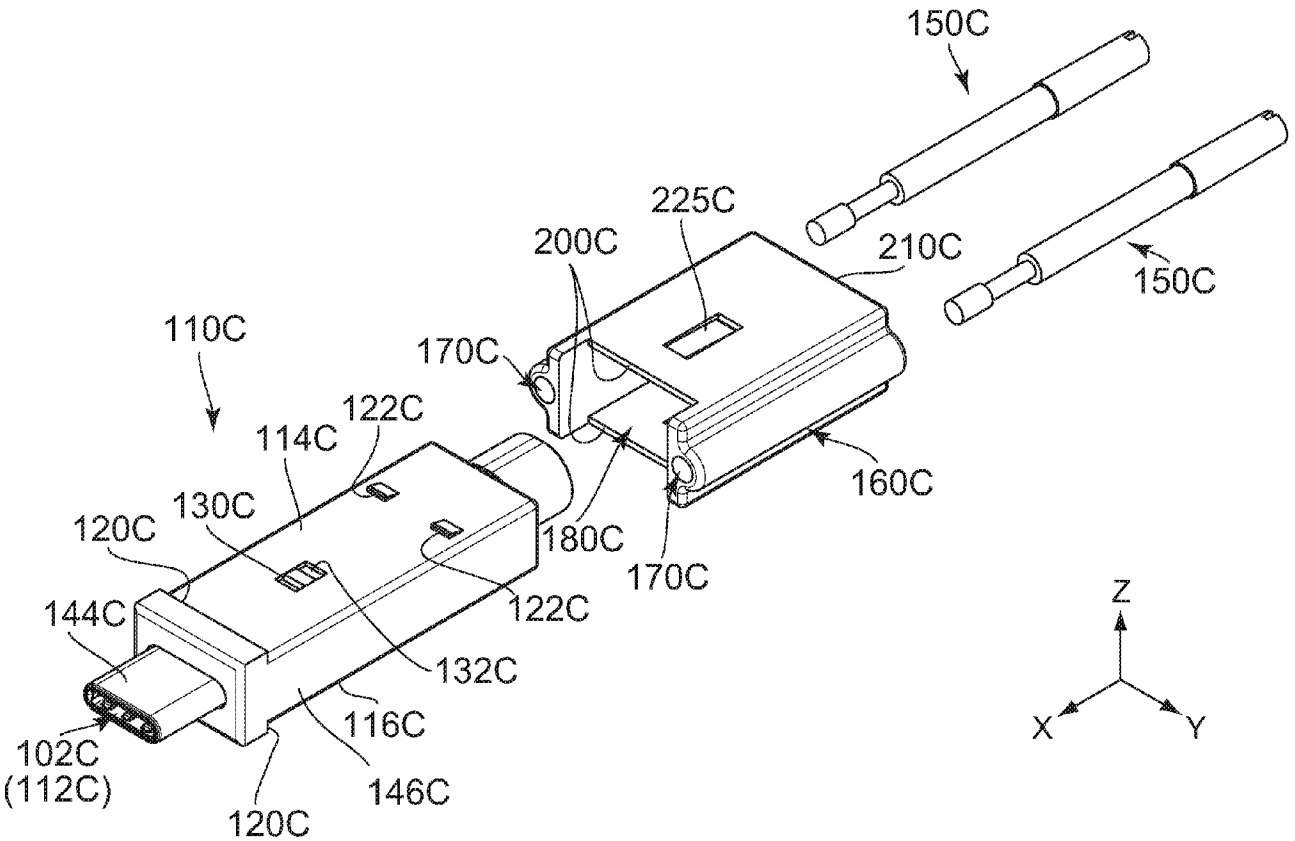
FIG. 42 is an exploded, perspective view showing the connector of FIG. 39.
Figure 43:
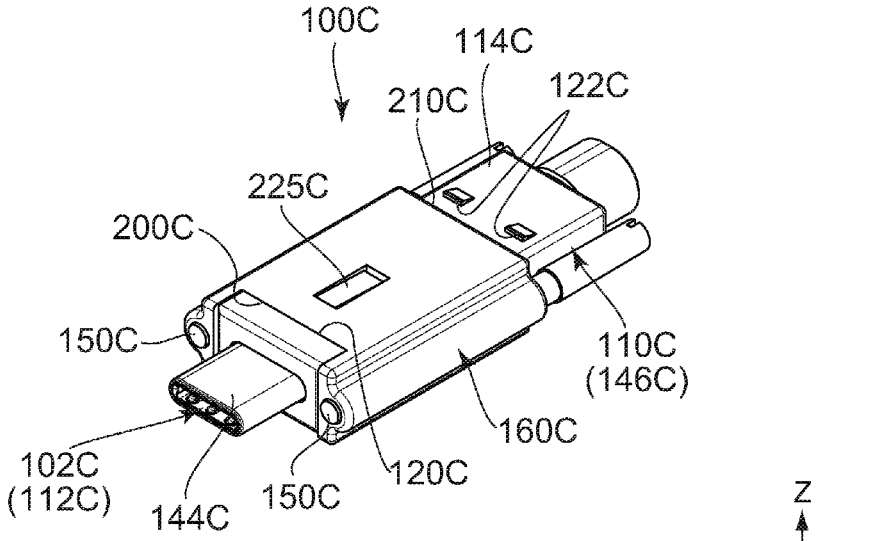
FIG. 43 is another top, perspective view showing the connector of FIG. 39.
Figure 44:
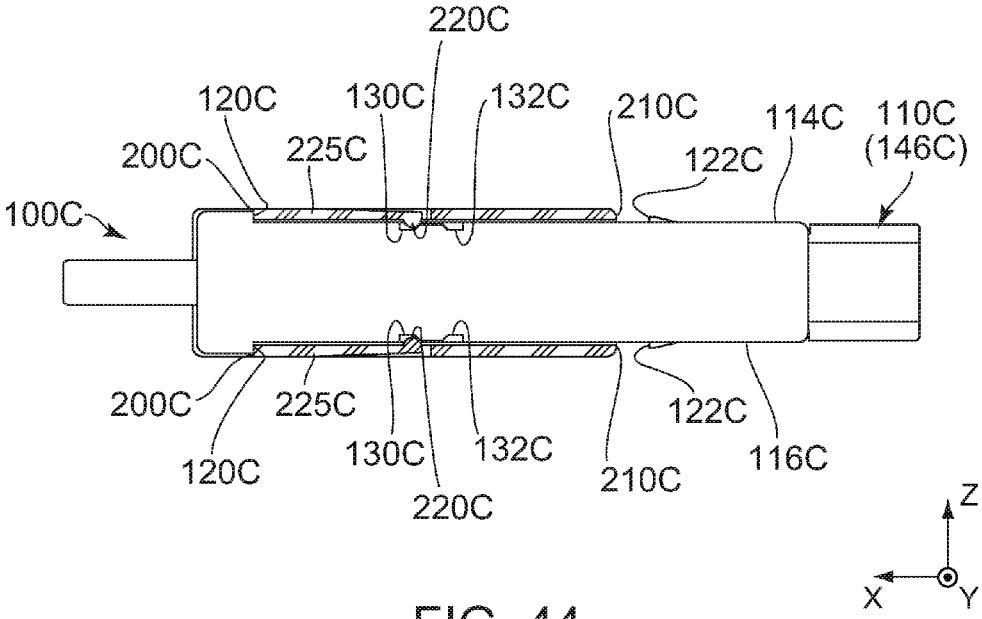
FIG. 44 is a view showing a positional relationship among each of front recesses, each of rear recesses and each of positioning projections which are included in the connector of FIG. 43. The positioning projection is accommodated in the front recess.
Figure 46:
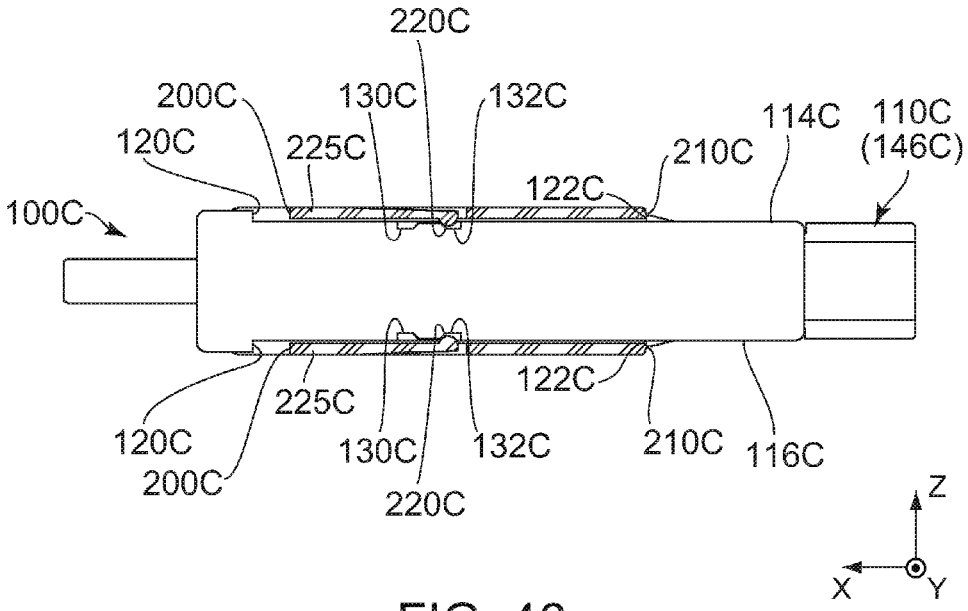
FIG. 46 is a view showing another positional relationship among each of the front recesses, each of the rear recesses and each of the positioning projections which are included in the connector of FIG. 45. The positioning projection is accommodated in the rear recess.

As understood from FIGS. 42, 44 and 46, each of an upper surface 114C and a lower surface 116C of the connector main 110C is provided with a front facing portion 120C and a rear facing portion 122C. However, the present invention is not limited thereto. The front facing portion 120C and the rear facing portion 122C may be provided on one of the upper surface 114C and the lower surface 116C of the connector main 110C. In the present embodiment, each of the front facing portions 120C and the rear facing portions 122C is formed on the hood 146C. In the present embodiment, each of the front facing portions 120C is a wall which is positioned at a front end of the hood 146C and which stands in the up-down direction, and each of the rear facing portions 122C is a projection which projects in the up-down direction. The front facing portion 120C functions as a regulated portion as described later.

Furthermore, each of the upper surface 114C and the lower surface 116C of the connector main 110C is provided with a front recess 130C and a rear recess 132C which are positioned away from each other in the predetermined direction. However, the present invention is not limited thereto. The front recess 130C and the rear recess 132C may be provided on one of the upper surface 114C and the lower surface 116C of the connector main 110C. In the present embodiment, each of the front recesses 130C and the rear recesses 132C is formed on the hood 146C.

The screw holding member 160C is attached to the connector main 110C and is relatively movable along the predetermined direction with respect to the connector main 110C between a front predetermined position and a rear predetermined position.

As shown in FIG. 42, in detail, the screw holding member 160C is formed with two side accommodation portions 170C and a center accommodation portion 180C. Each of the side accommodation portions 170C and the center accommodation portion 180C pierces the screw holding member 160C in the predetermined direction. As shown in FIG. 39, each of the screw holding member 160C is provided with two male screw seats 172C. As understood from FIGS. 4, 5 and 39, the male screw seat 172C is a surface which is brought into contact with the female screw seat 340 when the male screw member 150C is connected with the female screw portion 330. As shown in FIG. 39, the male screw seat 172C of the present embodiment is a front end surface of the screw holding member 160C. As understood from FIGS. 39 and 42, the side accommodation portions 170C partially accommodate the male screw members 150C, respectively. Each of the side accommodation portions 170C accommodates the male screw member 150C corresponding thereto in a manner similar to a manner in which the screw accommodation member 170 of the aforementioned first embodiment accommodates the male screw member 150. The center accommodation portion 180C is positioned between the side accommodation portions 170C in the lateral direction while partially accommodating the connector main 110C so as to be movable in the predetermined direction.

As understood from FIGS. 42, 44 and 46, the screw holding member 160C is provided with two pairs each consisting of the front abutment portion 200C and the rear abutment portion 210A. The front abutment portion 200C and the rear abutment portion 210C of each pair are edge portions of the center accommodation portion 180C. The front abutment portions 200C are front edges of the screw holding member 160C. The rear abutment portions 210C are rear edges of the screw holding member 160C. However, the present invention is not limited thereto. The front abutment portion 200C and the rear abutment portion 210C may be provided at one of an upper side and a lower side of the screw holding member 160C. The front abutment portions 200C face the front facing portions 120C, respectively, in the predetermined direction and are positioned rearward of the front facing portions 120C, respectively. In addition, the rear abutment portions 210C face the rear facing portions 122C, respectively, in the predetermined direction and are positioned forward of the rear facing portions 122A, respectively. Accordingly, each of the front facing portions 120C regulates a forward movement of the corresponding front abutment portion 200C beyond the front facing portion 120C in the predetermined direction, and each of the rear facing portions 122C regulates a rearward movement of the corresponding rear abutment portion 210C beyond the rear facing portion 122C in the predetermined direction. As understood from above, each of the front abutment portions 200C of the present embodiment functions as a regulating portion for the corresponding front facing portion (regulated portion) 120C.

Furthermore, the screw holding member 160C has two pairs each consisting of a spring portion 225C and a positioning projection 220C. The spring portions 225C and the positioning projections 220C of the two pairs are formed on opposite sides, respectively, of the screw holding member 160C in the up-down direction. However, the present invention is not limited thereto. The spring portion 225C and the positioning projection 220C may be provided on only one of an upper side and a lower side of the screw holding member 160C. Each of the spring portions 225C is resiliently deformable and supports the positioning projection 220C paired therewith. Each of the positioning projections 220C projects inside the center accommodation portion 180C in the up-down direction. Each of the positioning projections 220C is movable in the up-down direction by using resilience of the spring portion 225C paired therewith. The positioning projections 220C correspond to the front recesses 130C and the rear recesses 132C, respectively. Each of the positioning projection 220C of the present embodiment rides over a gap between the corresponding front recess 130C and the corresponding rear recess 132C by using resilience of the spring portion 225C paired therewith to be accommodated in one of the corresponding front recess 130C and the corresponding rear recess 132C so that each of the positioning projections 220C relatively positions the screw holding member 160C with respect to the connector main 110C in the predetermined direction.

As understood from FIGS. 39, 40, 43 and 44, in the present embodiment, when the screw holding member 160C is positioned at the front predetermined position, each of the front abutment portions 200A abuts against the corresponding front facing portion 120C while each of the positioning projections 220C is accommodated in the corresponding front recess 130C. In other words, a pair of the front abutment portion 200C and the corresponding front facing portion 120C and another pair of the positioning projection 220C and the corresponding front recess 130C define the front predetermined position. However, the present invention is not limited thereto. The front predetermined position may be defined only by the pair of the front abutment portion 200C and the corresponding front facing portion 120C. In addition, the front predetermined position may be defined only by the other pair of the positioning projection 220C and the corresponding front recess 130C. Furthermore, the front predetermined position may be defined by other means.

Figure 45:
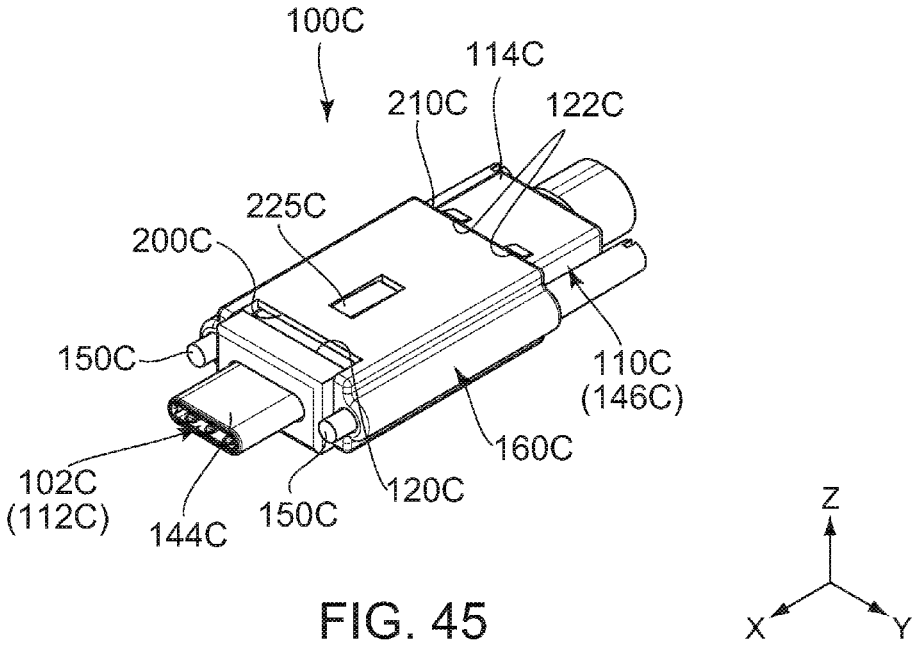
FIG. 45 is yet another top, perspective view showing the connector of FIG. 39.
Figure 47:
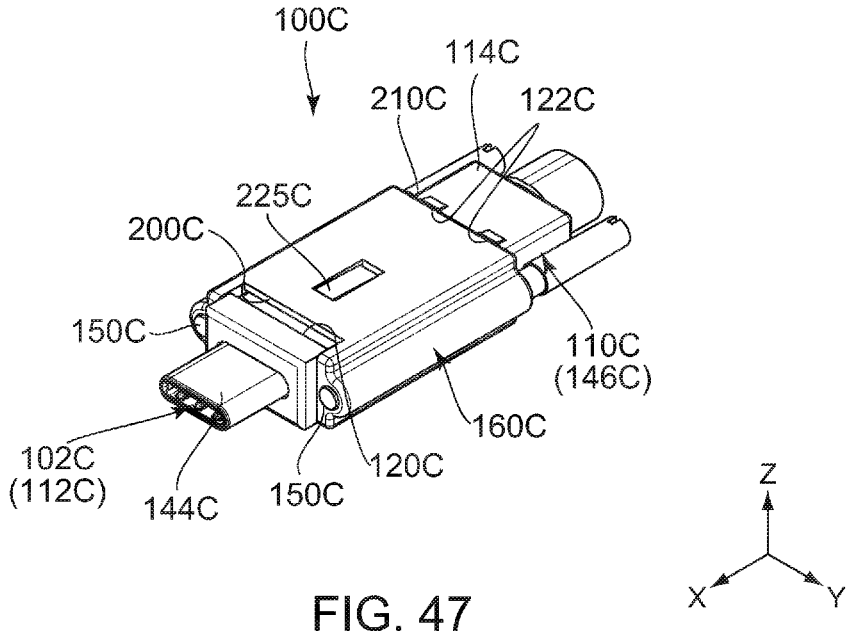
FIG. 47 is still another top, perspective view showing the connector of FIG. 39.

As understood from FIGS. 45 to 47, in the present embodiment, when the screw holding member 160C is positioned at the rear predetermined position, each of the rear abutment portions 210C abuts against the corresponding rear facing portion 122C while each of the positioning projections 220C is accommodated in the corresponding rear recess 132C. In other words, a pair of the rear abutment portion 210C and the corresponding rear facing portion 122C and another pair of the positioning projection 220C and the corresponding rear recess 132C define the rear predetermined position. However, the present invention is not limited thereto. The rear predetermined position may be defined only by the pair of the rear abutment portion 210C and the corresponding rear facing portion 122C. In addition, the rear predetermined position may be defined only by the other pair of the positioning projection 220C and the corresponding rear recess 132C. Furthermore, the rear predetermined position may be defined by other means.

In the present embodiment, the front predetermined position is arranged to satisfy the condition 1 described in the first embodiment, and the rear predetermined position is arranged to satisfy the condition 2 described in the first embodiment. Accordingly, the connector 100C of the present embodiment also has an effect similar to that of the first embodiment.

Fifth Embodiment

Figure 48:
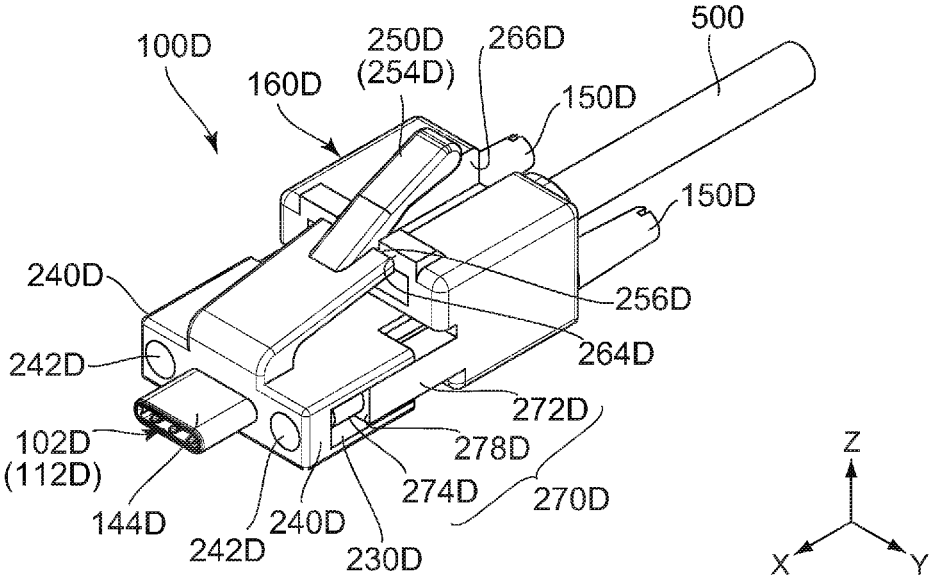
FIG. 48 is a top, perspective view showing a connector according to a fifth embodiment of the present invention.

Referring to FIG. 48, a connector 100D according to a fifth embodiment of the present invention is another modification the connector 100 of the first embodiment of FIG. 1 as described above. Specifically, similar to the connector 100 of the first embodiment, the connector 100D is to be connected with the connecting object. Accordingly, explanation about features of the connector 100D in common with the connector 100 of the aforementioned first embodiment is omitted. In the present embodiment, a predetermined direction, a lateral direction and an up-down direction are the X-direction, the Y-direction and the Z-direction, respectively. In addition, in the present embodiment, the positive X-direction is the forward direction while the negative X-direction is the rearward direction. Furthermore, in the present embodiment, the positive Z-direction is the upward direction while the negative direction is the downward direction.

Figure 49:
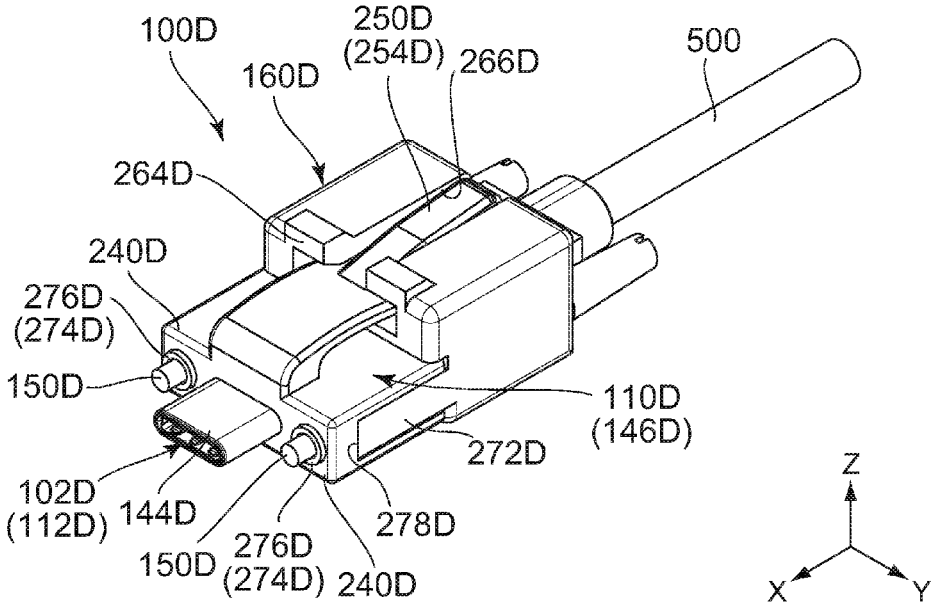
FIG. 49 is another top, perspective view showing the connector of FIG. 48.
Figure 50:
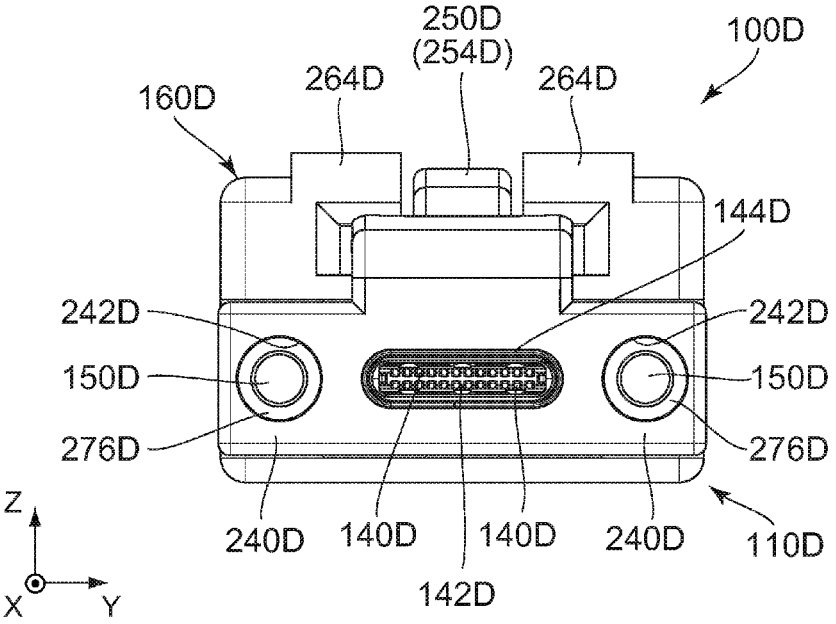
FIG. 50 is a front view showing the connector of FIG. 49.

As shown in FIGS. 48 to 52 and 54, a connector 100D includes a connector main 110D, two male screw members 150D and a screw holding member 160D. The connector main 110D of the present embodiment is positioned between the two male screw members 150D in the lateral direction. As shown in FIGS. 49 and 50, the connector main 110D includes contacts 140D, a holding member 142D, a shell 144D and a hood 146D similar to the first embodiment. The holding member 142D holds the contacts 140D. The shell 144D surrounds the holding member 142D. Explanation about those components is omitted.

As understood from FIGS. 48, 49, 51 and 52, the connector main 110D is provided with two guide portions 230D, two front wall portions 240D, an operation portion (lever) 250D and a positioning recess 258D. The positioning recess 258D is formed on a lower surface of the hood 146D.

Each of the guide portions 230D extends in the predetermined direction. In addition, the guide portions 230D are positioned at opposite ends, respectively, of the connector main 110D in the lateral direction. In other words, the guide portions 230D are positioned away from each other in the lateral direction. The front wall portions 240D correspond to the guide portions 230D. In the predetermined direction, each of the front wall portions 240D is positioned forward of the corresponding guide portion 230D. The front wall portions 240D are positioned away from each other in the lateral direction. Each of the front wall portions 240D is formed with a through hole 242D which pierces the front wall portions 240D in the predetermined direction. Each of the front wall portions 240D functions as a regulated portion as described later.

Figure 51:
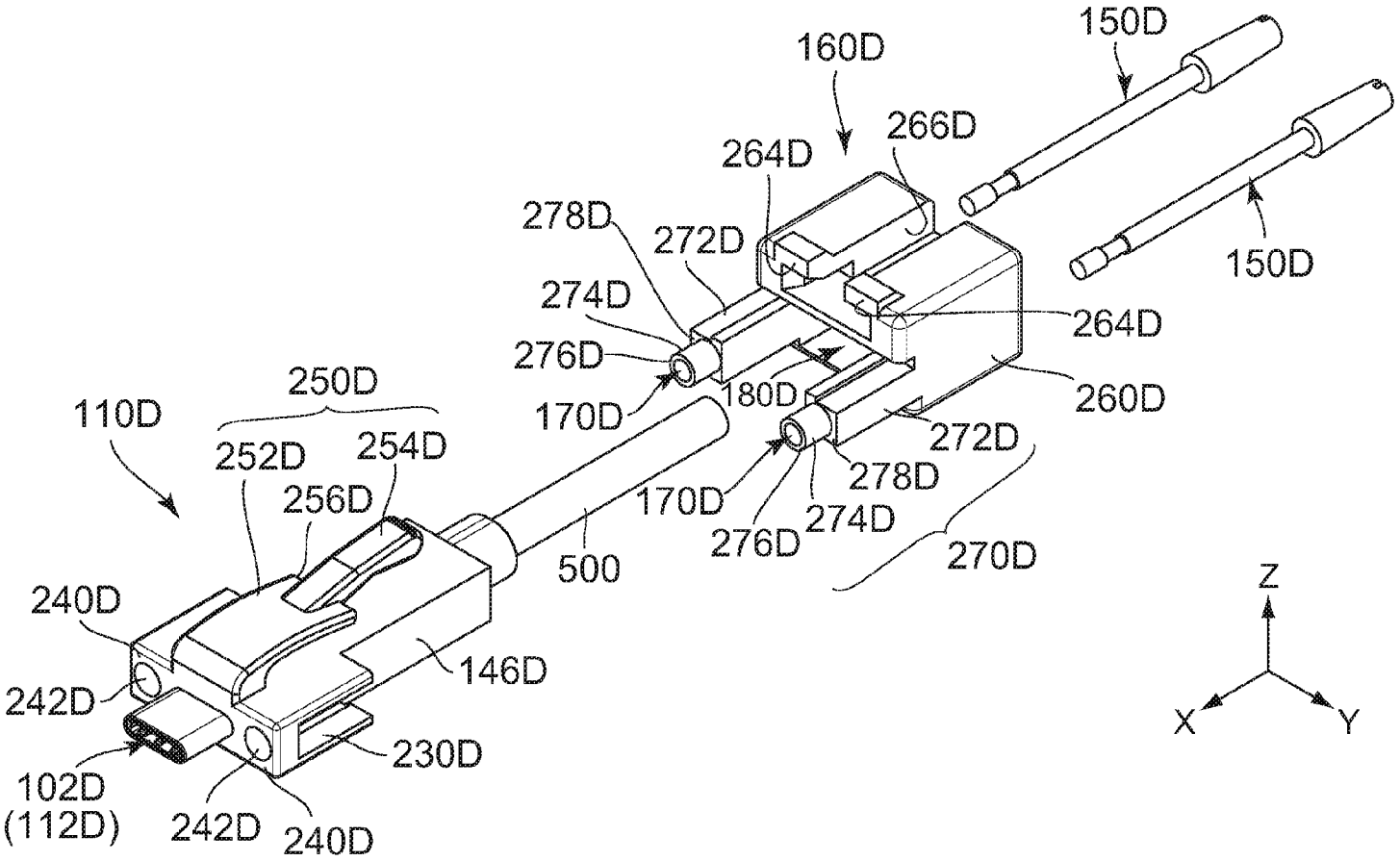
FIG. 51 is an exploded, top, perspective view showing the connector of FIG. 48.

As shown in FIGS. 48 to 51, the operation portion 250D extends upward from a vicinity of a front end of the hood 146D. As shown in FIG. 51, in detail, the operation portion 250D of the connector main 110D is formed with a wide portion 252D and a narrow portion 254D. Specifically, the wide portion 252D extends from the vicinity of the front end of the hood 146D, and the narrow portion 254D extends from the wide portion 252D. In the lateral direction, the narrow portion 254D has a size smaller than a size of the wide portion 252D. The operation portion 250D has a boundary portion between the wide portion 252D and the narrow portion 254D, and the boundary portion is formed with stopped portions 256D.

As understood from FIGS. 48 and 49, the screw holding member 160D is attached to the connector main 110D and is relatively movable along the predetermined direction with respect to the connector main 110D between a front predetermined position and a rear predetermined position.

Figure 53:
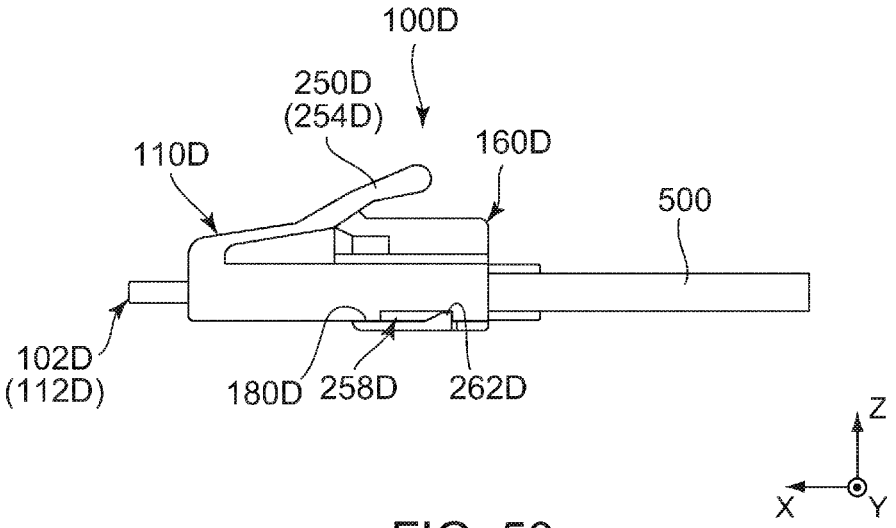
FIG. 53 is a view showing a positional relationship between a positioning projection and a positioning recess which are included in the connector of FIG. 48.
Figure 55:
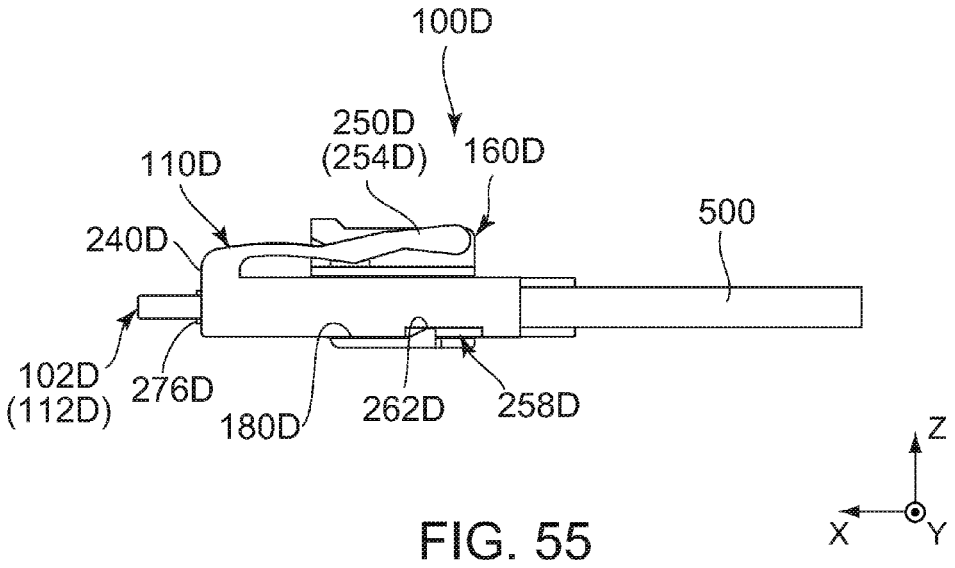
FIG. 55 is a view showing another positional relationship between the positioning projection and the positioning recess which are included in the connector of FIG. 54.
Figure 56:
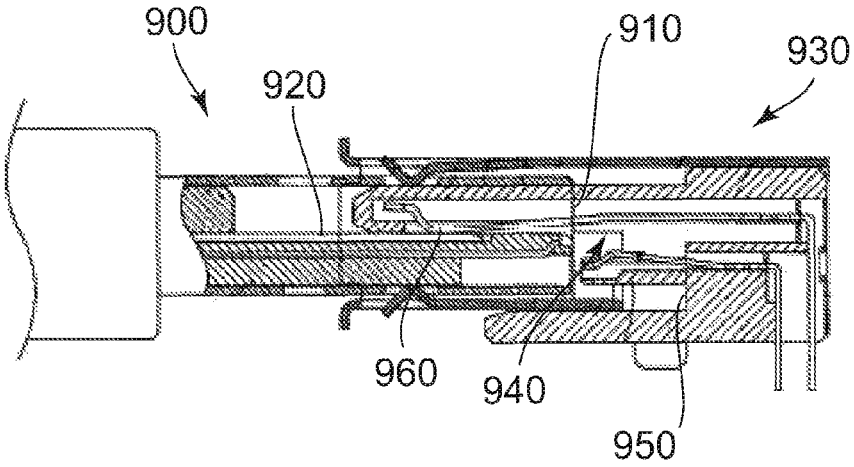
FIG. 56 PRIOR ART
FIG. 56 is a cross-sectional view showing a connector assembly of Patent Document 1.
Figure 57:
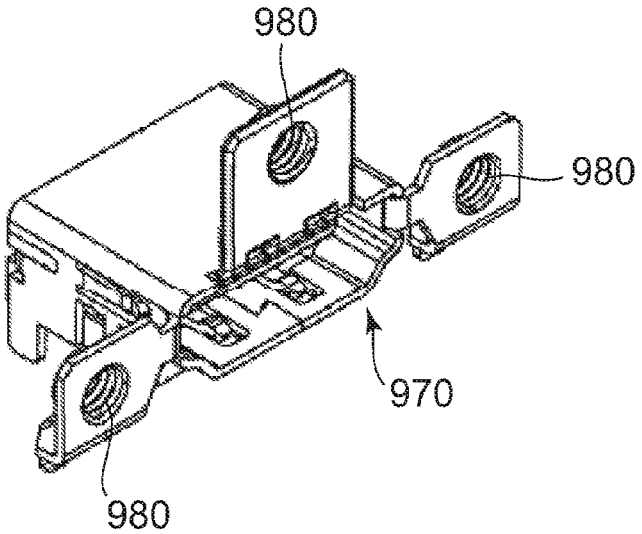
FIG. 57 PRIOR ART
FIG. 57 is a perspective view showing a receptacle of Patent Document 2.

As shown in FIG. 51, the screw holding member 160D is formed with two side accommodation portions 170D and a center accommodation portion 180D. Each of the side accommodation portions 170D and the center accommodation portion 180D pierces the screw holding member 160D in the predetermined direction. As understood from FIGS. 48, 49 and 51, the side accommodation portions 170D partially accommodate the male screw members 150D, respectively. Each of the side accommodation portions 170D accommodates the corresponding male screw member 150D in a manner similar to a manner in which the screw accommodation member 170 of the aforementioned first embodiment accommodates the male screw member 150. As shown in FIG. 51, the center accommodation portion 180D is positioned between the side accommodation portions 170D in the lateral direction. As shown in FIGS. 53 and 55, the center accommodation portion 180D partially accommodates the connector main 110D so as to be movable in the predetermined direction.

As shown in FIG. 51, in detail, the screw holding member 160D of the present embodiment is provided with a rear portion 260D and two arm portions 270D. The center accommodation portion 180D is provided on the rear portion 260D.

Figure 52:
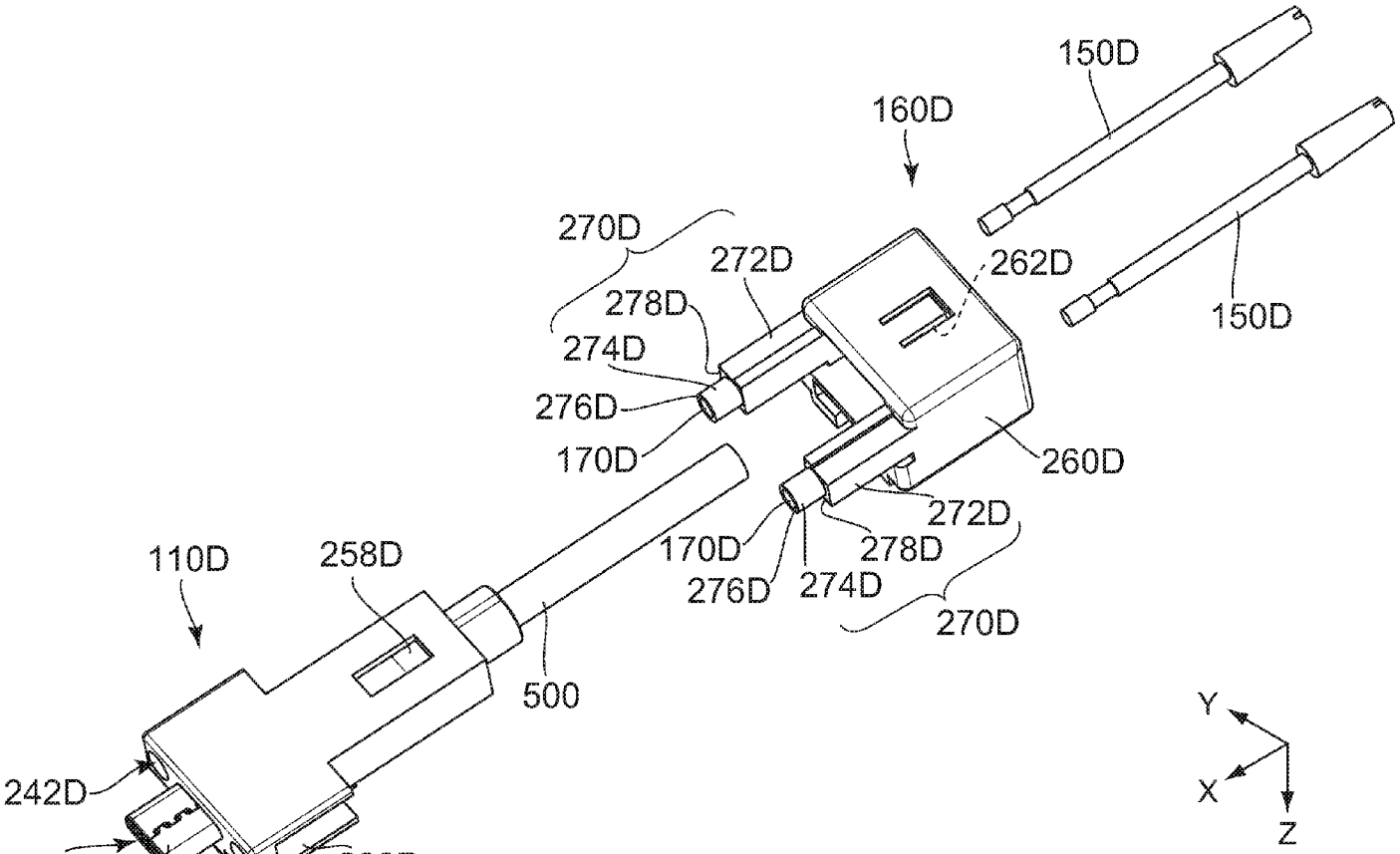
FIG. 52 is an exploded, bottom, perspective view showing the connector of FIG. 48.

As understood from FIGS. 52, 53 and 55, the rear portion 260D is provided with a positioning projection 262D which is positioned at a lower side thereof and which projects inward of the center accommodation portion 180D. The positioning projection 262D is accommodated in the positioning recess 258D of the connector main 110D. In the predetermined direction, the positioning recess 258D has a size greater than a size of the positioning projection 262D. Accordingly, the positioning projection 262D is movable in the positioning recess 258D. Meanwhile, the positioning projection 262D cannot be moved rearward beyond the positioning recess 258D. In other words, the positioning recess 258D regulates a rearward movement of the positioning projection 262D beyond the positioning recess 258D in the predetermined direction.

As shown in FIG. 51, the rear portion 260D of the screw holding member 160D is provided with stopping portions 264D and a slot 266D. The slot 266D extends rearward from the stopping portions 264D in the predetermined direction. As understood from FIGS. 48, 49 and 51, the slot 266D partially accommodates the narrow portion 254D of the operation portion 250D.

As shown in FIG. 48, under a state where the operation portion 250D is not operated, the stopped portions 256D are positioned forward of the stopping portions 264D, respectively, and regulate a forward movement of the screw holding member 160D. As understood from FIGS. 48, 49 and 54, when the operation portion 250D is operated so that the stopped portions 256D are moved in the up-down direction, the stopping portion 264D is released from the corresponding the stopped portion 256D so that the screw holding member 160D is movable forward.

As shown in FIG. 51, the arm portions 270D are positioned away from each other in the lateral direction. Each of the arm portions 270D extends forward from the rear portion 260D in the predetermined direction. The side accommodation portions 170D correspond to the arm portions 270D, respectively, and each of the side accommodation portions 170D is formed to continuously extend from the corresponding arm portion 270D to the rear portion 260D.

Each of the arm portions 270D has a guided portion 272D and a projecting portion 274D. The projecting portion 274D projects forward from the guided portion 272D. Specifically, a part of each of the side accommodation portions 170D is positioned in the corresponding projecting portion 274D. The guided portions 272D are received in the guide portions 230D, respectively, of the connector main 110D, and each of the guided portions 272D is guided by the corresponding guide portion 230D during its movement along the predetermined direction. Each of the arm portions 270D has a boundary portion between the guided portion 272D and the projecting portion 274D, and the boundary portion is provided with an abutment portion 278D which faces forward in the predetermined direction. Specifically, the abutment portion 278D is positioned around a rear end of the projecting portion 274D. Each of the projecting portions 274D has a front end and the front end functions as a male screw seat 276D.

Figure 54:
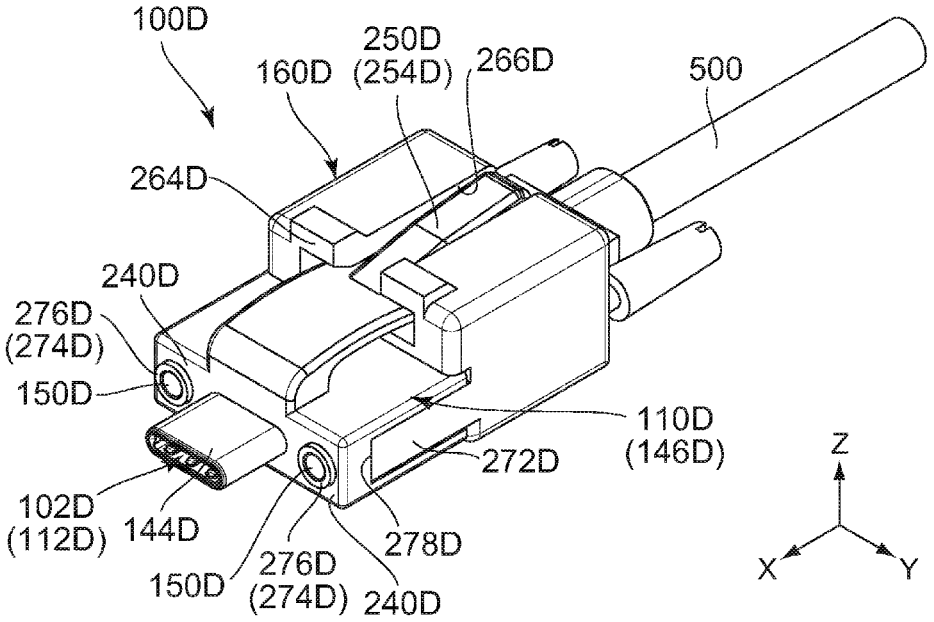
FIG. 54 is yet another top, perspective view showing the connector of FIG. 48.

As understood from FIGS. 48 and 49, the projecting portions 274D are projectable forward through the through holes 242D, respectively, by a relative movement of the screw holding member 160D with respect to the connector main 110D. As understood from FIGS. 48 and 51, the abutment portions 278D face the front wall portions 240D, respectively, in the predetermined direction, and each of the abutment portions 278D is positioned rearward of the corresponding front wall portion 240D. As shown in FIGS. 49 and 54, a maximum amount of projection of each of the projecting portions 274D from the corresponding front wall portion 240D is defined by the corresponding abutment portion 278D abutting against the corresponding front wall portion 240D. As understood form above, each of the abutment portions 278D of the present embodiment functions as a regulating portion for the corresponding front wall portion (regulated portion) 240D.

As understood from FIGS. 49, 54 and 55, in the present embodiment, when the screw holding member 160D is positioned at the front predetermined position, each of the abutment portions 278D abuts against the corresponding front wall portion 240D. In other words, the abutment portions 278D and the front wall portions 240D define the front predetermined position. However, the present invention is not limited thereto. The front predetermined position may be defined by other means.

As understood from FIGS. 48 and 53, in the present embodiment, when the screw holding member 160D is positioned at the rear predetermined position, each of the stopped portions 256D is positioned forward of the corresponding stopping portion 264D while the positioning projection 262D is positioned in the positioning recess 258D. In other words, a pair of the stopping portions 264D and the stopped portions 256D and another pair of the positioning projection 262D and the positioning recess 258D define the rear predetermined position. However, the present invention is not limited thereto. The rear predetermined position may be defined by other means.

In the present embodiment, the front predetermined position is arranged to satisfy the condition 1 described in the first embodiment, and the rear predetermined position is arranged to satisfy the condition 2 described in the first embodiment. Accordingly, the connector 100D of the present embodiment also has an effect similar to that of the first embodiment.

While the present invention has been described with specific embodiments, the present invention is not limited to the aforementioned embodiments. For example, the concept of the first, fourth or fifth embodiment may be applied to a connector having a single male screw member. Furthermore, the concept of the second or third embodiment may be applied to a connector having two male screw members.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector having a front end in a predetermined direction and being selectively connectable with a first connecting object and a second connecting object along the predetermined direction, wherein:

the first connecting object comprises a first fitting portion having a mating contact, and further comprises a female screw portion and a female screw seat;

the second connecting object comprises a second fitting portion having a structure corresponding to the first fitting portion;

the connector comprises a connector main, a male screw member and a screw holding member;

the connector main is selectively mateable with the first fitting portion and the second fitting portion in the predetermined direction;

the connector main has a contact which is brought into contact with the mating contact when the connector and the first connecting object are connected with each other;

the screw holding member holds the male screw member;

the screw holding member has a male screw seat which is brought into contact with the female screw seat when the male screw member is connected with the female screw portion;

the screw holding member is attached to the connector main; and the screw holding member is relatively movable with respect to the connector main in the predetermined direction in a state in which the screw holding member is attached to the connector main.

2. The connector as recited in claim 1, wherein the male screw member is relatively movable with respect to the screw holding member in the predetermined direction.

3. The connector as recited in claim 2, wherein:

the screw holding member is provided with an accommodation portion and a projection;

the accommodation portion extends in the predetermined direction;

the projection projects into the accommodation portion in a plane perpendicular to the predetermined direction;

the male screw member is formed with a recess which is recessed in a direction perpendicular to the predetermined direction; and the male screw member is partially accommodated in the accommodation portion while the projection is accommodated in the recess.

4. The connector as recited in claim 1, wherein:

the connector main has an end which forms the front end of the connector;

the screw holding member is movable between a front predetermined position and a rear predetermined position in the predetermined direction;

each of the first fitting portion and the second fitting portion has a receiving portion which has an inner wall in the predetermined direction;

when the connector is connected with the first connecting object, the connector main is partially received in the receiving portion of the first fitting portion;

when the screw holding member is positioned at the front predetermined position, the end of the connector main faces the inner wall of the first fitting portion but does not reach the inner wall under a state where the male screw member is connected with the female screw portion and where the male screw seat is brought into contact with the female screw seat;

when the connector is connected with the second connecting object, the connector main is partially received in the receiving portion of the second fitting portion; and when the screw holding member is positioned at the rear predetermined position, the end of the connector main is able to reach the inner wall of the second fitting portion under a state where the connector is connected with the second connecting object.

5. The connector as claimed in claim 4, wherein:

the connector main is to be connected with a cable which extends rearward in the predetermined direction;

the connector main is provided with a regulated portion;

the screw holding member is provided with a regulating portion;

the regulating portion is arranged rearward of the regulated portion in the predetermined direction;

the regulating portion faces the regulated portion in the predetermined direction; and the regulating portion regulates a rearward movement of the regulated portion beyond the regulating portion in the predetermined direction.

6. The connector as recited in claim 5, wherein the regulating portion and the regulated portion define the front predetermined position for the screw holding member.

7. The connector as recited in claim 1, wherein:

the connector has two of the male screw members; and the connector main is positioned between the two male screw members in a lateral direction perpendicular to the predetermined direction.

8. The connector as recited in claim 7, wherein:

the screw holding member comprises two screw accommodation members, an upper movable member and a lower movable member;

the screw accommodation members partially accommodate the male screw members, respectively;

each of the upper movable member and the lower movable member couples the screw accommodation members with each other in the lateral direction;

the upper movable member and the lower movable member sandwich the connector main in an up-down direction perpendicular to both of the predetermined direction and the lateral direction;

the connector main has an upper surface and a lower surface in the up-down direction;

the upper movable member is movable on the upper surface of the connector main in the predetermined direction; and the lower movable member is movable on the lower surface of the connector main in the predetermined direction.

9. The connector as recited in claim 8, wherein:

at least one of the upper movable member and the lower movable member has a front abutment portion;

at least one of the upper surface and the lower surface of the connector main is provided with a front facing portion; and the front facing portion faces the front abutment portion in the predetermined direction and regulates a forward movement of the front abutment portion beyond the front facing portion in the predetermined direction.

10. The connector as recited in claim 8, wherein:

at least one of the upper movable member and the lower movable member has a positioning projection which projects inward in the up-down direction;

at least one of the upper surface and the lower surface of the connector main is provided with a front recess and a rear recess which are positioned away from each other in the predetermined direction; and the positioning projection is accommodated in one of the front recess and the rear recess so that the screw holding member is relatively positioned with respect to the connector main in the predetermined direction.

11. The connector as recited in claim 7, wherein:

the screw holding member is formed with two side accommodation portions and a center accommodation portion;

each of the side accommodation portions and the center accommodation portion pierces the screw holding member in the predetermined direction;

the side accommodation portions partially accommodate the male screw members, respectively;

the center accommodation portion is positioned between the side accommodation portions in the lateral direction; and the center accommodation portion partially accommodates the connector main so as to be movable in the predetermined direction.

12. The connector as recited in claim 11, wherein:

the center accommodation portion is provided with a front abutment portion;

the connector main is provided with a front facing portion; and the front facing portion faces the front abutment portion in the predetermined direction and regulates a forward movement of the front abutment portion beyond the front facing portion in the predetermined direction.

13. The connector as recited in claim 11, wherein:

the screw holding member is provided with two projecting portions and two abutment portions;

the projecting portions are positioned away from each other in the lateral direction;

parts of the side accommodation portions are positioned in the projecting portions, respectively;

each of the projecting portions has a rear end in the predetermined direction;

the abutment portions correspond to the projecting portions, respectively;

each of the abutment portions is positioned around the rear end of the corresponding projecting portion;

each of the projecting portions has a front end in the predetermined direction;

the front ends of the projecting portions function as the male screw seats, respectively;

the connector main is provided with two front wall portions;

the front wall portions are positioned away from each other in the lateral direction;

each of the front wall portions is formed with a through hole which pierces the front wall portion in the predetermined direction;

the projecting portions are able to project forward through the through holes, respectively, by a relative movement of the screw holding member with respect to the connector main;

the abutment portions face the front wall portions, respectively, in the predetermined direction;

each of the abutment portions is positioned rearward of the corresponding front wall portion in the predetermined direction; and a maximum amount of projection of each of the projecting portions from the corresponding front wall portion is defined by the corresponding abutment portion abutting against the corresponding front wall portion.

14. The connector as recited in claim 11, wherein:

the screw holding member has a positioning projection which projects inward of the center accommodation portion in an up-down direction perpendicular to both of the predetermined direction and the lateral direction;

the connector main is provided with a positioning recess which accommodates the positioning projection; and the positioning recess regulates a rearward movement of the positioning projection beyond the positioning recess in the predetermined direction.

15. The connector as recited in claim 11, wherein:

the connector main is formed with an operation portion;

the operation portion is formed with a stopped portion;

the screw holding member is provided with a stopping portion and a slot;

the slot extends rearward from the stopping portion in the predetermined direction;

the slot partially accommodates the operation portion;

under a state where the operation portion is not operated, the stopped portion is positioned ahead of the stopping portion to regulate a forward movement of the screw holding member in the predetermined direction; and when the operation portion is operated so that the stopped portion is moved in an up-down direction perpendicular to both of the predetermined direction and the lateral direction, the stopping portion is released from the stopped portion so that the screw holding member is forward movable in the predetermined direction.

16. The connector as recited in claim 11, wherein:

the screw holding member has a positioning projection which projects inward of the center accommodation portion in an up-down direction perpendicular to both of the predetermined direction and the lateral direction;

the connector main is provided with a front recess and a rear recess;

each of the front recess and the rear recess is recessed inward in the up-down direction;

the front recess and the rear recess are positioned away from each other in the predetermined direction; and the positioning projection is accommodated in one of the front recess and the rear recess so that the screw holding member is relatively positioned with respect to the connector main in the predetermined direction.

17. The connector as recited in claim 1, wherein the male screw member is positioned above the connector main in an up-down direction perpendicular to the predetermined direction.

18. The connector as recited in claim 17, wherein:

the screw holding member comprises an upper accommodation member and a movable member;

the movable member is held by the connector main so as to be movable in the predetermined direction; and the upper accommodation member is attached to the movable member and partially accommodates the male screw member.

19. The connector as recited in claim 18, wherein:

the connector main has a ditch and a positioning projection;

the ditch extends in the predetermined direction;

the positioning projection projects into the ditch in a lateral direction perpendicular to both of the predetermined direction and the up-down direction;

the movable member has an upper portion and a side portion;

the upper accommodation member is attached to the upper portion;

the side portion extends downward in the up-down direction from the upper portion;

the side portion is, at least in part, accommodated in the ditch;

the side portion is provided with a positioned portion;

when the movable member is moved along the predetermined direction, the positioned portion rides over the positioning projection; and the movable member is positioned in the predetermined direction by positioning the positioned portion forward or rearward of the positioning projection in the predetermined direction.

20. The connector as recited in claim 19, wherein:

the upper portion of the movable member has a front abutment portion;

the connector main is provided with a front facing portion; and the front facing portion faces the front abutment portion in the predetermined direction and regulates a forward movement of the front abutment portion beyond the front facing portion in the predetermined direction.

21. The connector as recited in claim 17, wherein:

the connector main is formed with a slot;

the screw holding member has a movable portion and an upper accommodation portion;

the movable portion is accommodated in the connector main so as to be movable in the predetermine direction;

the upper accommodation portion is provided on the movable portion and is exposed outside the connector main through the slot; and the upper accommodation portion partially accommodates the male screw member.

22. The connector as recited in claim 21, wherein:

an inside of the connector main is provided with a front facing portion;

the movable portion has a front abutment portion; and the front facing portion faces the front abutment portion in the predetermined direction and regulates a forward movement of the front abutment portion beyond the front facing portion in the predetermined direction.

23. The connector as recited in claim 21, wherein:

the slot has a rear edge;

the upper accommodation portion has an rear end portion; and the rear edge of the slot faces the rear end portion of the upper accommodation portion in the predetermined direction and regulates a rearward movement of the rear end portion beyond the rear edge in the predetermined direction.

24. The connector as recited in claim 1, wherein the connector is in conformity to Universal Serial Bus Type-C Standard.

25. A connector assembly comprising the connector as recited in claim 1 and a mating connector as the first connecting object, wherein:

the mating connector comprises the first fitting portion, the female screw portion and the female screw seat.

* * * * *